US009550368B2

(12) United States Patent
Takagiwa

(10) Patent No.: US 9,550,368 B2
(45) Date of Patent: Jan. 24, 2017

(54) PRINT DEVICE

(71) Applicant: BROTHER KOGYO KABUSHIKI KAISHA, Nagoya-shi, Aichi-ken (JP)

(72) Inventor: Yutaka Takagiwa, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 3 days.

(21) Appl. No.: 14/858,700

(22) Filed: Sep. 18, 2015

(65) Prior Publication Data

US 2016/0082744 A1 Mar. 24, 2016

(30) Foreign Application Priority Data

Sep. 24, 2014 (JP) ..... 2014-194248

(51) Int. Cl.
*B41J 2/175* (2006.01)
*B41J 2/18* (2006.01)
*B41J 29/02* (2006.01)

(52) U.S. Cl.
CPC ..... *B41J 2/17596* (2013.01); *B41J 2/175* (2013.01); *B41J 2/1752* (2013.01); *B41J 2/17523* (2013.01); *B41J 2/18* (2013.01); *B41J 29/02* (2013.01)

(58) Field of Classification Search
USPC ..... 347/85, 86
See application file for complete search history.

(56) References Cited

U.S. PATENT DOCUMENTS 6,168,268 B1 * 1/2001 Sugiyama ..... B41J 2/17509 347/89
6,281,916 B1 * 8/2001 VanSteenkiste ..... B41J 2/175 347/85
6,474,797 B2 * 11/2002 Kurata ..... B41J 2/17509 347/85
6,582,067 B2 * 6/2003 Matsuzaki ..... B41J 2/17503 347/85
6,814,432 B2 * 11/2004 Yamada ..... B41J 2/175 347/85
6,883,905 B2 * 4/2005 Kimura ..... B41J 2/175 347/85
7,926,924 B2 * 4/2011 Umeda ..... B41J 2/17596 347/84

(Continued)

FOREIGN PATENT DOCUMENTS

JP 2003-159809 A 6/2003

*Primary Examiner* — Matthew Luu
*Assistant Examiner* — Lily Kemathe
(74) *Attorney, Agent, or Firm* — Fox Rothschild LLP

(57) ABSTRACT

A mount portion mounts a container containing liquid. A fluid passages connects the mount portion to a head portion provided to inject liquid. A reservoir portion reserves liquid and is provided on the fluid passage. An open-close valve is provided on a connection path which is a part of the fluid passage and connects the mount portion to the reservoir portion. The control unit controls opening and closing of the open-close valves such that a first valve open time period for the open-close valve provided on a first connection path is shorter than a second valve open time period for the open-close valve provided on a second connection path. The pressure of the liquid that flows in the reservoir portion from the first connection path is higher than the pressure of the liquid that flows in the reservoir portion from the second connection path.

12 Claims, 18 Drawing Sheets

(56) References Cited

U.S. PATENT DOCUMENTS

| | | | | |
|---|---|---|---|---|
| 8,403,439 | B2 * | 3/2013 | Tanaka | B41J 2/175 347/17 |
| 8,449,087 | B2 * | 5/2013 | Kataoka | B41J 2/18 347/84 |
| 2001/0040610 | A1 * | 11/2001 | Kurata | B41J 2/17509 347/85 |
| 2002/0113852 | A1 * | 8/2002 | Kimura | B41J 2/175 347/85 |
| 2002/0158954 | A1 | 10/2002 | Usui et al. | |
| 2003/0202059 | A1 * | 10/2003 | Kimura | B41J 2/175 347/85 |
| 2003/0210309 | A1 * | 11/2003 | Kimura | B41J 2/175 347/85 |
| 2003/0227524 | A1 * | 12/2003 | Yamada | B41J 2/175 347/85 |
| 2009/0046132 | A1 * | 2/2009 | Izawa | B41J 2/16523 347/85 |
| 2009/0051722 | A1 * | 2/2009 | Kaiho | B41J 29/38 347/17 |
| 2009/0174735 | A1 * | 7/2009 | Yamada | B41J 2/175 347/7 |
| 2012/0024395 | A1 * | 2/2012 | Furukawa | B41J 2/175 137/14 |
| 2012/0033003 | A1 * | 2/2012 | Tanaka | B41J 2/175 347/6 |
| 2016/0082730 | A1 * | 3/2016 | Takagiwa | B41J 2/175 347/47 |

* cited by examiner

PRINT DEVICE

CROSS-REFERENCE TO RELATED APPLICATION

This application claims priority to Japanese Patent Application No. 2014-194248 filed on Sep. 24, 2014, the disclosure of which is herein incorporated by reference in its entirety.

BACKGROUND

The present invention relates to a print device.

There is known a print device that includes a plurality of mount portions each of which mounts a container configured to contain liquid. The print device comprises, for example, a print head, a plurality of main tanks, and a plurality of sub-tanks. The plurality of the sub-tanks are mounted onto the print device. The print head injects an ink. The sub-tanks are reservoir portions which are arranged at flow passages connecting the plurality of the main tanks to the print head, respectively. The ink is supplied from the main tank to the sub-tank, and in turn supplied from the sub-tank to the print head.

SUMMARY

When a plurality of sub-tanks are disposed, the pressure of the ink flowing into one sub-tank may differ from the pressure of the ink flowing into another sub-tank. If the pressure of the ink flowing into the respective sub-tanks is not the same, those sub-tanks which receive the ink at a higher pressure may receive more ink than other sub-tanks which receive the ink at a lower pressure. This can create a large difference in the amount of reserved ink among the sub-tanks. If there is a large difference in the amount of reserved ink among the sub-tanks, the liquid head may not be the same among the sub-tanks. The nozzle face of the recording head, which is configured to inject an ink, has a meniscus formed thereon by a surface tension of the ink to hold the ink. Thus, if the liquid surface is not the same among the sub-tanks, the meniscus may be destroyed in one or more nozzles. This can become a cause of non-injection of the ink.

Various embodiments of the general principles described herein provide a print device that reduces a difference in the amount of reserved liquid among a plurality of reservoir portions.

Various embodiments of the general principles described herein provide a print device including a head portion, a plurality of mount portions, a plurality of fluid passages, a plurality of reservoir portions, a plurality of open-close valves, and a control unit. The head portion has a nozzle face. The nozzle face has a nozzle to inject a liquid. Each of the mount portions is configured to mount a container that contains the liquid. Each of the fluid passages connects corresponding one of the mount portions to the head portion. Each of the reservoir portions is configured to reserve the liquid, and is provided on each of the fluid passages. Each of the open-close valves is provided on each of connection paths. The connection paths are part of the fluid passages, and configured to connect the mount portions to the reservoir portions. The control unit controls opening and closing of the respective open-close valves such that a first valve open time period for the open-close valve provided on a first connection path is shorter than a second valve open time period for the open-close valve provided on a second connection path. The first connection path and the second connection path are included in the connection paths. The pressure of the liquid that flows in the reservoir portion from the first connection path is higher than the pressure of the liquid that flows in the reservoir portion from the second connection path.

BRIEF DESCRIPTION OF THE DRAWINGS

Embodiments will be described below in detail with reference to the accompanying drawings in which.

DETAILED DESCRIPTION

Referring now to FIG. 1 to FIG. 17, a configuration of a printer 1 will be described below. Note that the top side, the bottom side, the lower left side, the upper right side, the lower right side, and the upper left side in FIG. 1 respectively correspond to the top side, the bottom side, the front side, the rear side, the right side, and the left side of the printer 1.

Figure 1:
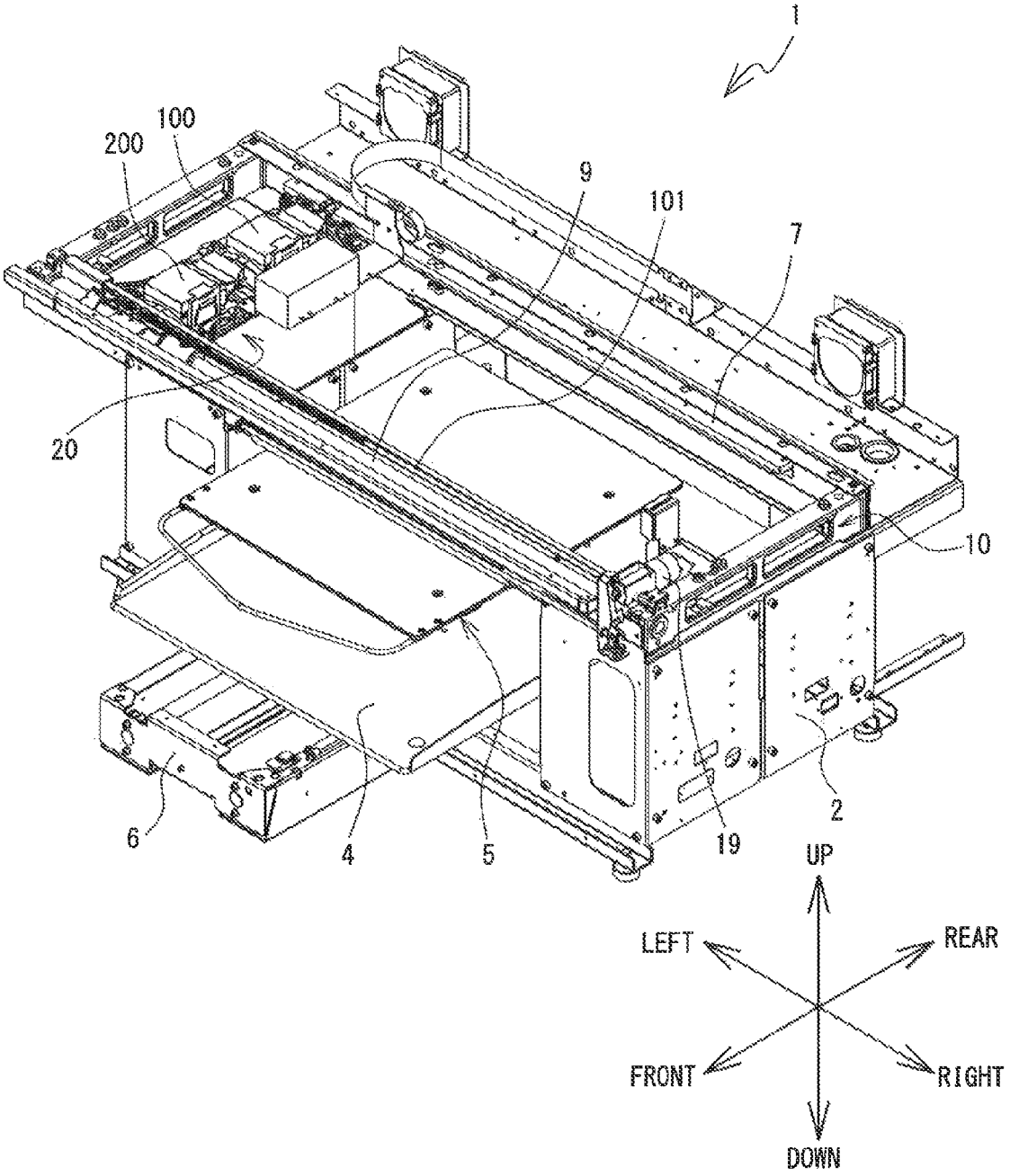
FIG. 1 is a perspective view of a printer.

As shown in FIG. 1, the printer 1 is an inkjet printer, and configured to inject a liquid ink 97 (see FIG. 2) onto a fabric (not shown) such as a T-shirt, which is a printing medium, and print a desired image on the fabric. The printing media may be paper or the like. In this embodiment, the printer 1 injects five different kinds of ink 97 (white, black, yellow, cyan, and magenta) downward to print a color image on the printing medium. In the following description, the while ink 97 among the five kinds of ink 97 (see FIG. 2) may be referred to as a white ink, and the four colors of ink 97, i.e., black, cyan, yellow and magenta, may collectively be referred to as a color ink. The white ink is high precipitationability liquid that contains a component precipitating faster than the color ink. The component that has high precipitationability is, for example, a pigment such as titanium oxide.

For instance, the white ink is injected onto the fabric, and then the color ink are injected subsequent to the injection of the white ink. The white ink is used as, for example, a foundation when printing an image on the fabric that has a dark ground color. It is also possible to use the white ink in a different printing application than injecting the color ink subsequent to injecting the white ink. Specifically, the fabric surface may include an area injected with the white ink only, and an area injected with the color ink only. For a certain image to be printed, the white ink injection may be subsequent to the color ink injection.

The printer 1 includes a housing 2, a platen drive mechanism 6, a pair of guide rails (not shown), a platen 5, a tray 4, a frame body 10, a guide shaft 9, a rail 7, a carriage 20, head units 100 and 200, a drive belt 101, and a drive motor 19.

The housing 2 has a substantially rectangular parallelepiped shape that has the longitudinal direction in the right-left direction. On the right front of the housing 2, there is provided an operation unit (not shown) for operating the printer 1. The operation unit includes a display and operation buttons. The display is configured to display various pieces of information. An operator operates the operation buttons when the operator enters commands and instructions in connection with desired movements, motions and actions of the printer 1.

The frame body 10 has a frame shape, which has a substantially rectangular shape when viewed from the top, and is located on top of the housing 2. The frame body 10 supports the guide shaft 9 at its front side, and supports the rail 7 at its rear side. The guide shaft 9 is a shaft member that has a shaft portion extending in the right-left direction inside the frame body 10. The rail 7 is a rod-shaped member extending in the right-left direction, and located to face the guide shaft 9.

Figure 2:
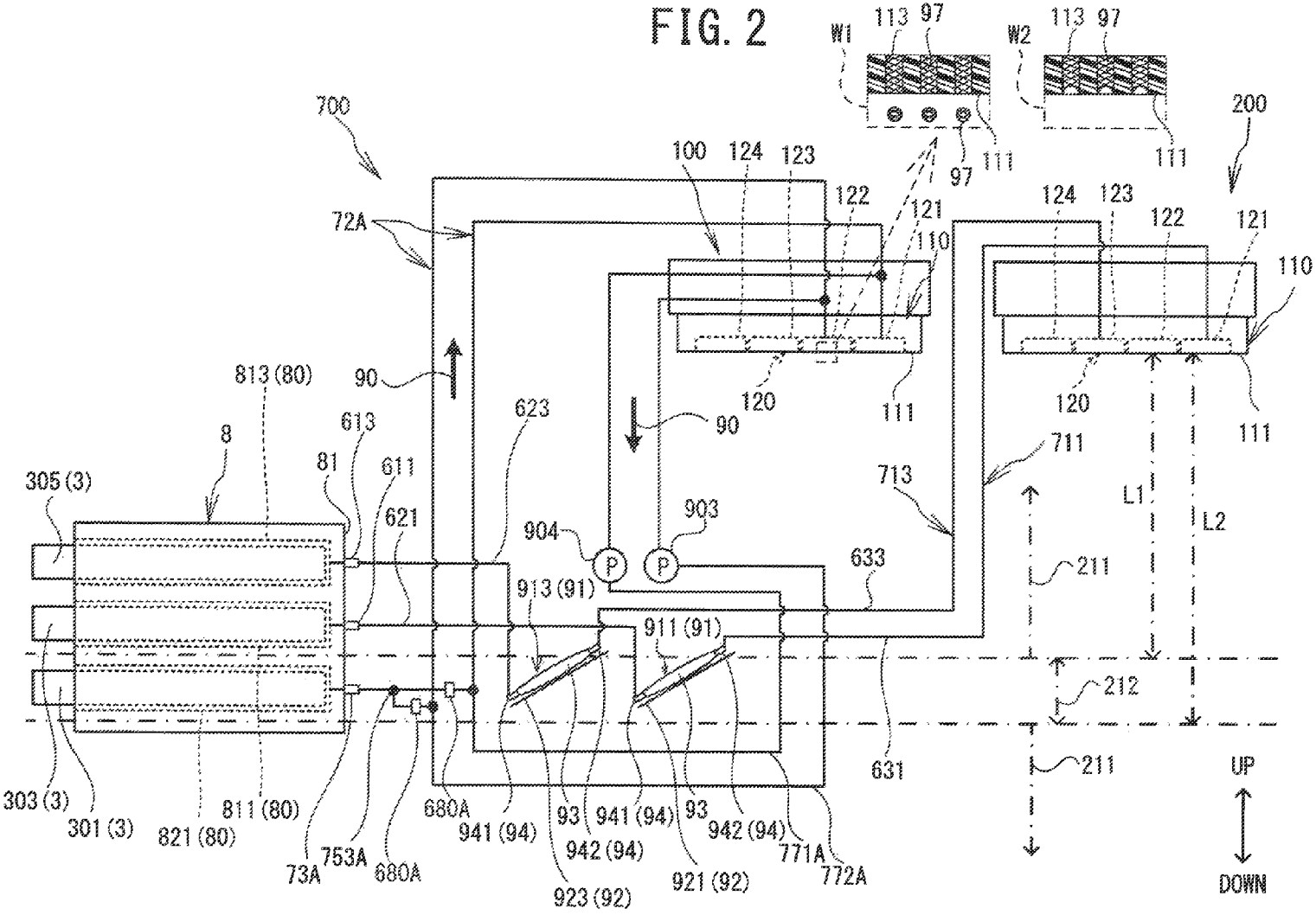
FIG. 2 is a schematic view of part of an ink passage.
Figure 3:
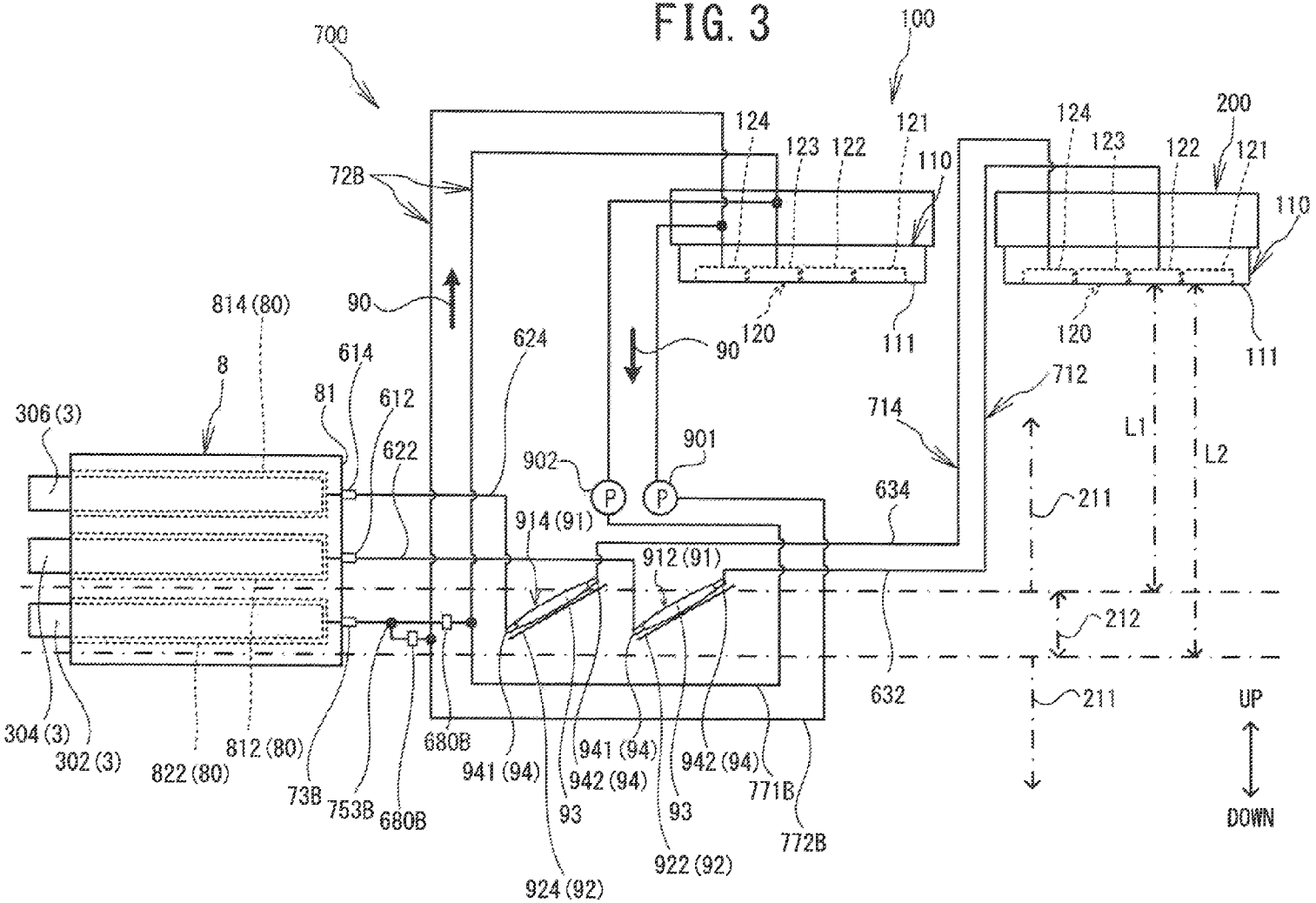
FIG. 3 is a schematic view of another part of the ink passage.

The carriage 20 can move along the guide shaft 9 in the right-left direction. The head units 100 and 200 are arranged in the front-rear direction, and mounted on the carriage 20. The head unit 100 is located behind the head unit 200. As shown in FIG. 2 and FIG. 3, each of the head units 100 and 200 has a head portion 110 at a lower part thereof. FIG. 2 and FIG. 3 schematically illustrate the vertical locations of respective elements and members of the flow passages of the inks 97. As such, FIG. 2 and FIG. 3 depict the head units 100 and 200 side by side in the drawing sheets although the head units 100 and 200 are in fact viewed from the front. The head portion 110 of the head unit 100 injects the white ink. The head portion 110 of the head unit 200 injects the color ink.

The head portion 110 has a nozzle face 111. The nozzle face 111 is a flat surface that is parallel to the horizontal direction, and includes a plurality of fine nozzles 113 (see FIG. 2) configured to inject the inks 97 downward. The nozzle face 111 defines a bottom face of each of the head units 100 and 200. The nozzles 113 are provided in a nozzle arrangement area 120 of the nozzle face 111. The nozzle arrangement area 120 is formed in a center area of the nozzle face 111 in the right-left direction, and extends in the front-rear direction.

The nozzle face 111 has a plurality of nozzle arrays 121-124. Each of the nozzle arrays 121-124 is an array of a plurality of nozzles 113. Each of the nozzle arrays 121-124 is located in corresponding one of four regions defined by dividing the nozzle arrangement area 120 into four parts in the right-left directions. From the right to the left, there are arranged the nozzle array 121, the nozzle array 122, the nozzle array 123 and the nozzle array 124 in this order.

Each of the nozzle arrays 121-124 of the head unit 100 can inject the white ink. The nozzle arrays 121 and 122 of the head unit 100 are coupled to a single cartridge 301 that reserves the white ink (see FIG. 2 and FIG. 4). The nozzle arrays 123 and 124 of the head unit 100 are coupled to another cartridge 302 that reserves the white ink (see FIG. 3 and FIG. 4).

Figure 4:
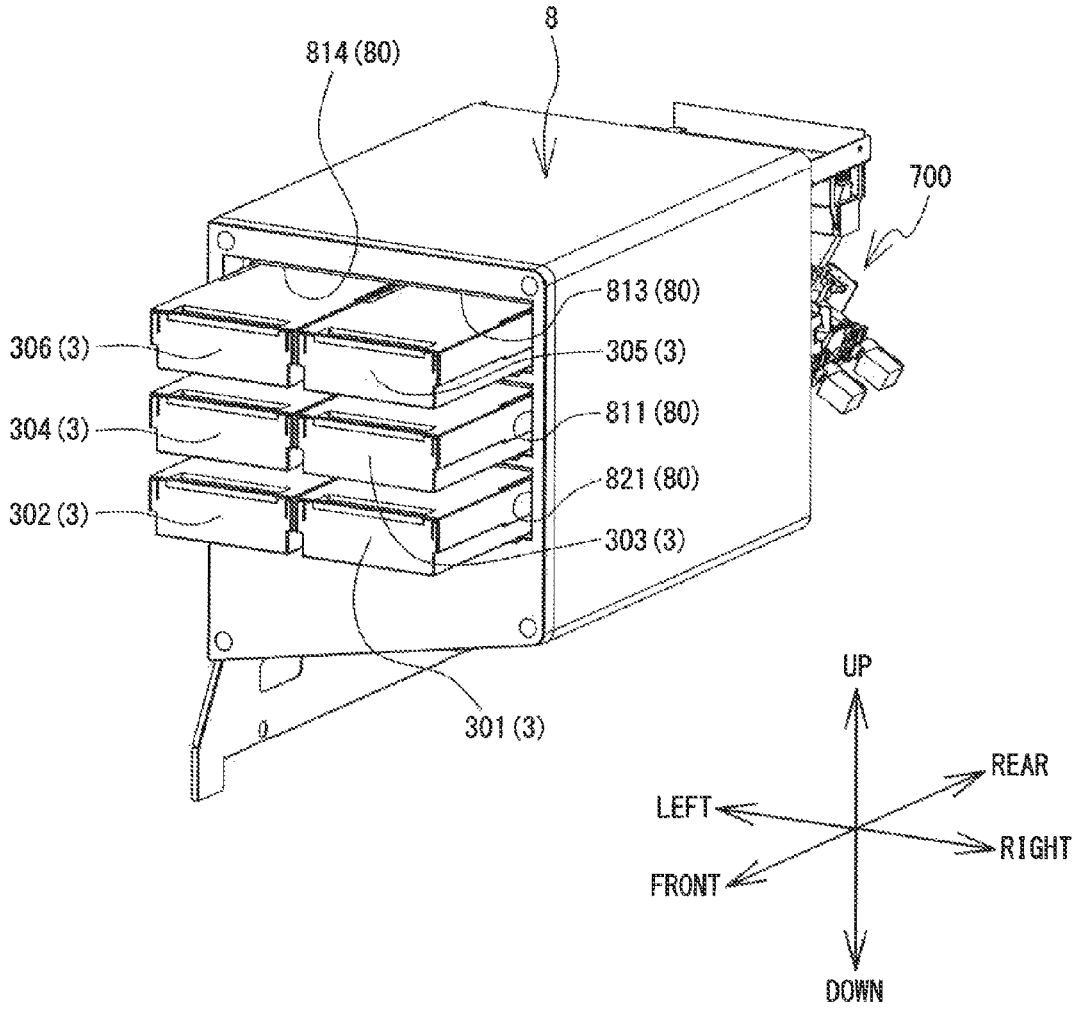
FIG. 4 is a perspective view of a mount frame portion.

As shown in FIG. 2 and FIG. 3, each of the nozzle arrays 121-124 of the head unit 200 is coupled to corresponding one of cartridges 303-306 that retain the color inks. The nozzle array 121 of the head unit 200 is coupled to the cartridge 303 of the magenta ink (see FIG. 2 and FIG. 4), the nozzle array 122 is coupled to the cartridge 304 of the cyan ink (see FIG. 3 and FIG. 4), the nozzle array 123 is coupled to the cartridge 305 of the yellow ink (see FIG. 2 and FIG. 4), and the nozzle array 124 is coupled to the cartridge 306 of the black ink (FIG. 3 and FIG. 4).

As shown in FIG. 1, the drive belt 101 has a strip shape spanning in the right-left direction inside the frame body 10. The drive belt 101 is flexible, and is made from, for example, synthetic resin. The drive motor 19 is provided at the right front area inside the frame body 10, and can rotate in the normal and reverse directions. The drive motor 19 is operatively connected to the carriage 20 via the drive belt 101. As the drive motor 19 drives the drive belt 101, the carriage 20 moves back and forth along the guide shaft 9 in the right-left direction. Accordingly, the head units 100 and 200 move back and forth in the right-left direction, and inject the inks 97 toward the platen 5 that is located below the head units 100 and 200 and faces the head units 100 and 200.

The platen drive mechanism 6 has a pair of guide rails (not shown) and a platen support (not shown). The two guide rails extend in the front-rear direction inside the platen drive mechanism 6, and support the platen support such that the platen support can move in the front-rear direction. The platen support is configured to support the platen 5 at an upper part thereof. The platen 5 supports the printing medium.

The tray 4 is provided below the platen 5. The tray 4 supports sleeves of the T-shirt when the operator puts the T-shirt on the platen 5. Thus, the sleeves of the T-shirt do not contact components other than the tray in the housing 2.

The platen drive mechanism 6 is configured to be driven by a motor (not shown) provided at a rear end of the printer 1. The platen drive mechanism 6 is configured to move the platen support and the platen 5 in the front-rear direction of the housing 2 along the paired guide rails. As the platen 5 transports the printing medium in the front-rear direction (sub-scanning direction) and the head portion 110 injects the inks 97 while moving in the right-left direction in the reciprocal manner, the printer 1 prints on the printing medium.

A mount frame portion 8 shown in FIG. 4 is provided on the right side of the printer 1. The mount frame portion 8 is supported by the housing 2 (not shown in FIG. 4). The mount frame portion 8 has a plurality of mount portions 80, and each of the mount portions 80 is configured to mount the cartridge 3. Each mount portion 80 is a recess that has a rectangular parallelepiped shape, and is concave in the rear direction from the front face of the mount frame portion 8. The inner rear end of each mount portion 80 has a hollow needle (not shown) extending toward the front. As the cartridge 3 is mounted in the mount portion 80, the hollow needle sticks in a rubber lid (not shown) provided at a mouth plug 70 (see FIG. 5) of a liquid container 31 received in the cartridge 3. The hollow needle draws out the ink 97 from the liquid container 31 (see FIG. 5) held in the cartridge 3.

Figure 5:
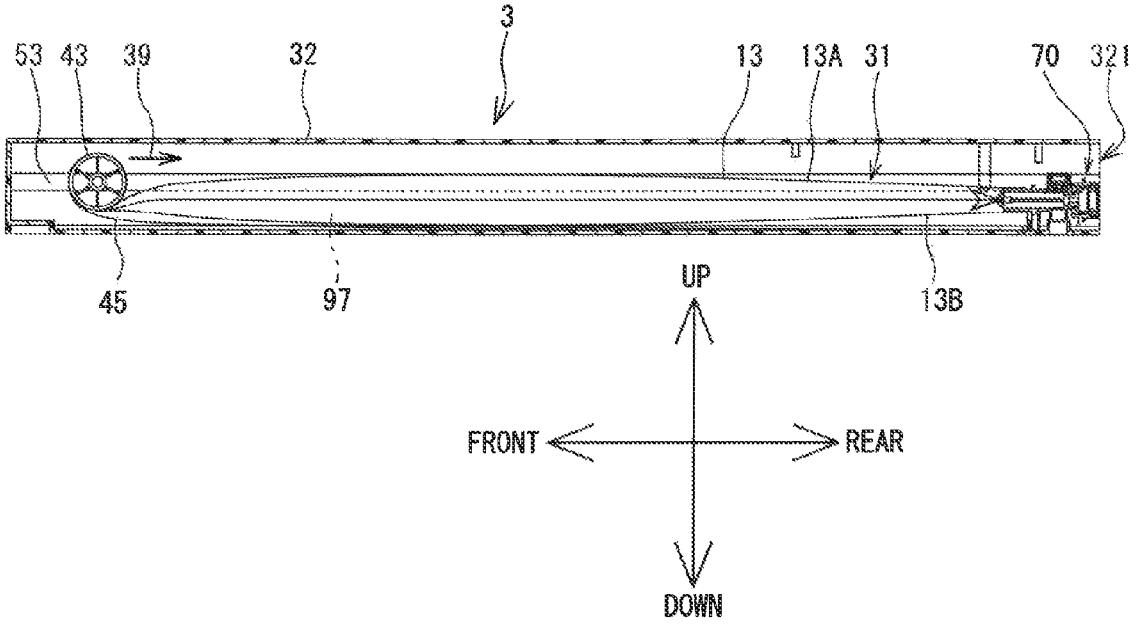
FIG. 5 is a vertical cross-sectional view of a cartridge.

As shown in FIG. 5, the cartridge 3 has a casing 32, the liquid container 31, a shaft 43, and a resilient member 45. The casing 32 is a rectangular parallelepiped, which is generally elongated in the front-rear direction. The casing 32 has an opening 321 at its rear end. The liquid container 31 is located in the casing 32. The liquid container 31 has a liquid bag 13 and the mouth plug 70. The liquid bag 13 is a bag-like container formed by placing rectangular flexible films 13A and 13B one after another, which are made from synthetic resin or the like, such that one face of one of the films faces one face of the other film, and heating and fusing the peripheries of the two films (by means of thermal seal) to connect the two films 13A and 13B to each other. The liquid bag 13 extends in the front-rear direction. The mouth plug 70 is attached to the rear end of the liquid bag 13, and is exposed rearward from the opening 321 of the casing 32. The mouth plug 70 is a cylindrical element extending in the rear direction, and a rubber plug (not shown) disposed in the mouth plug 70 provides a seal such that the ink 97 in the liquid bag 13 does not leak.

The shaft 43 has a cylindrical shape extending in the right-left direction. The shaft 43 has projections (not shown) at right and left ends thereof such that the projections project outwardly in the right and left directions respectively. The projections are located in recesses 53 provided at right and left side faces in the casing 32. The recesses 53 are depressed outwardly in the right and left directions, respectively, and extend in the front-rear direction. The resilient member 45 extend on the bottom face in the front-rear direction inside the casing 32. A rear end of the resilient member 45 is secured to a rear part of the casing 32, and a front end of the resilient member 45 is wound around the shaft 43 such that the resilient member 45 biases the shaft 43 and exerts a returning force in the rear direction. Thus, the shaft 43 winds up the liquid bag 13 and collects the ink 97 toward the mouth plug 70 as the shaft 43 moves in the rear direction. In other words, the shaft 43 moves in the rear direction as the remaining amount of ink 97 in the liquid container 31 decreases (see the arrow 39 in FIG. 5).

The ink 97 is supplied to the nozzle face 111 from the cartridge 3 engaged in the mount portion 80. As shown in FIG. 2 and FIG. 3, a region in the up-down direction is referred to as a first region 211. The first region 211 is a region in which a distance from the nozzle face 111 in the up-down direction is out of a predetermined range. Also, a region in the up-down direction is referred to as a second region 212. The second region 212 is a region in which a distance from the nozzle face 111 in the up-down direction is in the predetermined range. In this embodiment, the predetermined range is a range in which a distance measured from the nozzle face 111 in the downward direction falls within a range between the distances L1 and L2. For example, L1 is 10 mm and L2 is 50 mm. As shown in the enlarged view W2 in FIG. 2, a meniscus is created at the nozzle face 111 by the surface tension, i.e., the ink 97 is concave in the nozzle 113. The meniscus holds the ink 97 at the nozzle face 111. When the ink 97 is supplied toward the nozzle face 111 from the second region 212, which is the predetermined range apart from the nozzle face 111 by the predetermined distance in the up-down direction, the meniscus is difficult to break, and it is possible to properly inject the ink 97.

Figure 6:
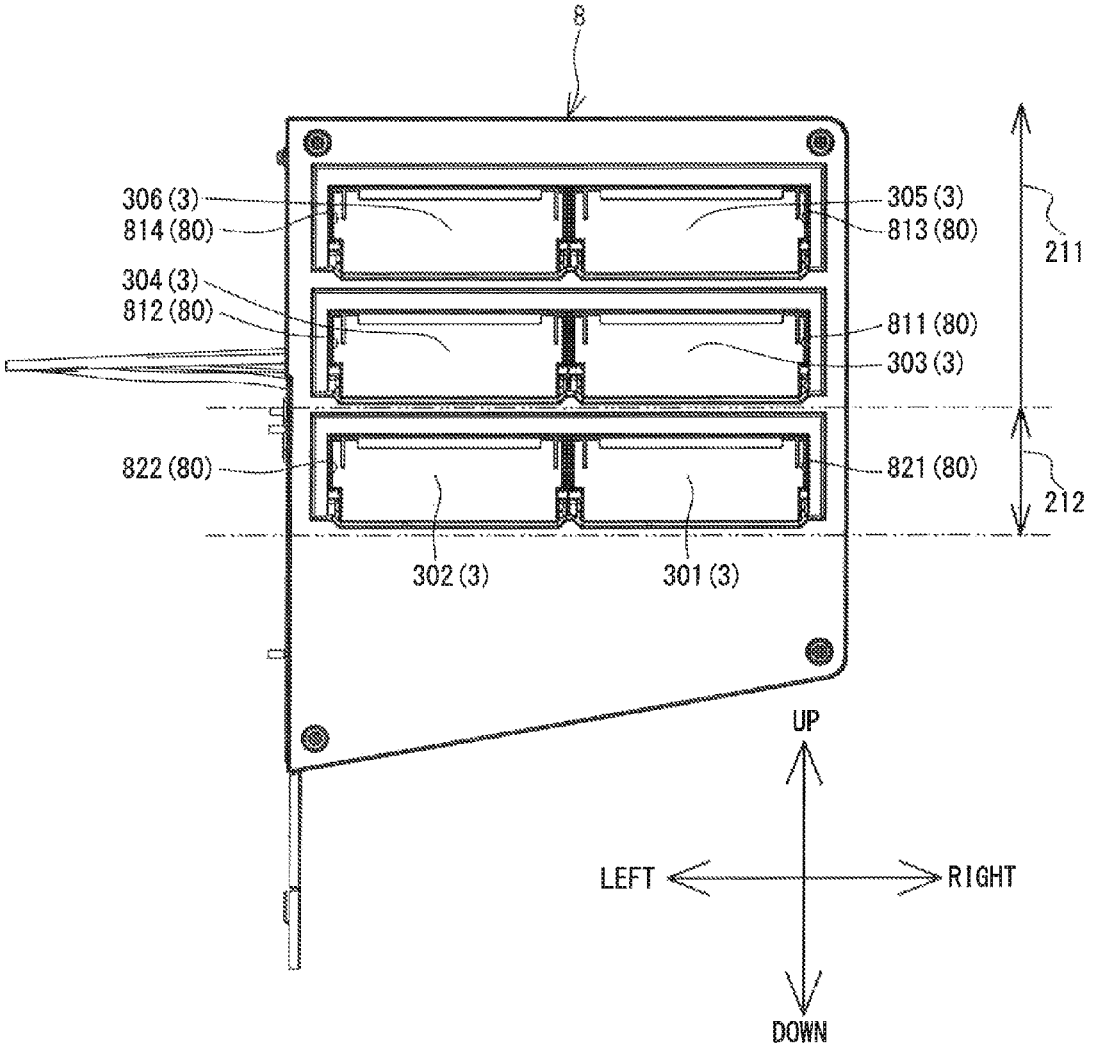
FIG. 6 is a front view of the mount frame portion.

As shown in FIG. 4 and FIG. 6, the mount portions 80 are arranged in two columns side by side in the right-left direction and in three tiers in the up-down direction. As shown in FIG. 2, FIG. 3 and FIG. 6, the mount portions 80 include upper mount portions 811-814 located in the first region 211, and lower mount portions 821 and 822 located in the second region 212. In this embodiment, the lower mount portions 821 and 822 are located below the upper mount portions 811-814. Specifically, as shown in FIG. 6, the lower mount portion 821 is located at the lower right area of the mount frame portion 8, and the lower mount portion 822 is located on the left of the lower mount portion 821. The upper mount portions 811 and 812 are located above the lower mount portions 821 and 822, respectively, and the upper mount portions 813 and 814 are located above the upper mount portions 811 and 812, respectively. The upper mount portions 811 and 813 are located such that the upper mount portions 811 and 813 are aligned in the up-down direction in the first region 211 at the upper side of the second region 212. The upper mount portions 812 and 814 are arranged such that the upper mount portions 812 and 814 are located in the up-down direction in the first region 211 at the upper side of the second region 212.

The lower mount portions 821 and 822 can mount the cartridges 301 and 302, respectively. Each of the cartridges 301 and 302 contains the white ink. The upper mount portions 811 to 814 can mount the cartridges 303 to 306, respectively. The cartridges 303-306 contain the color inks.

Figure 7:
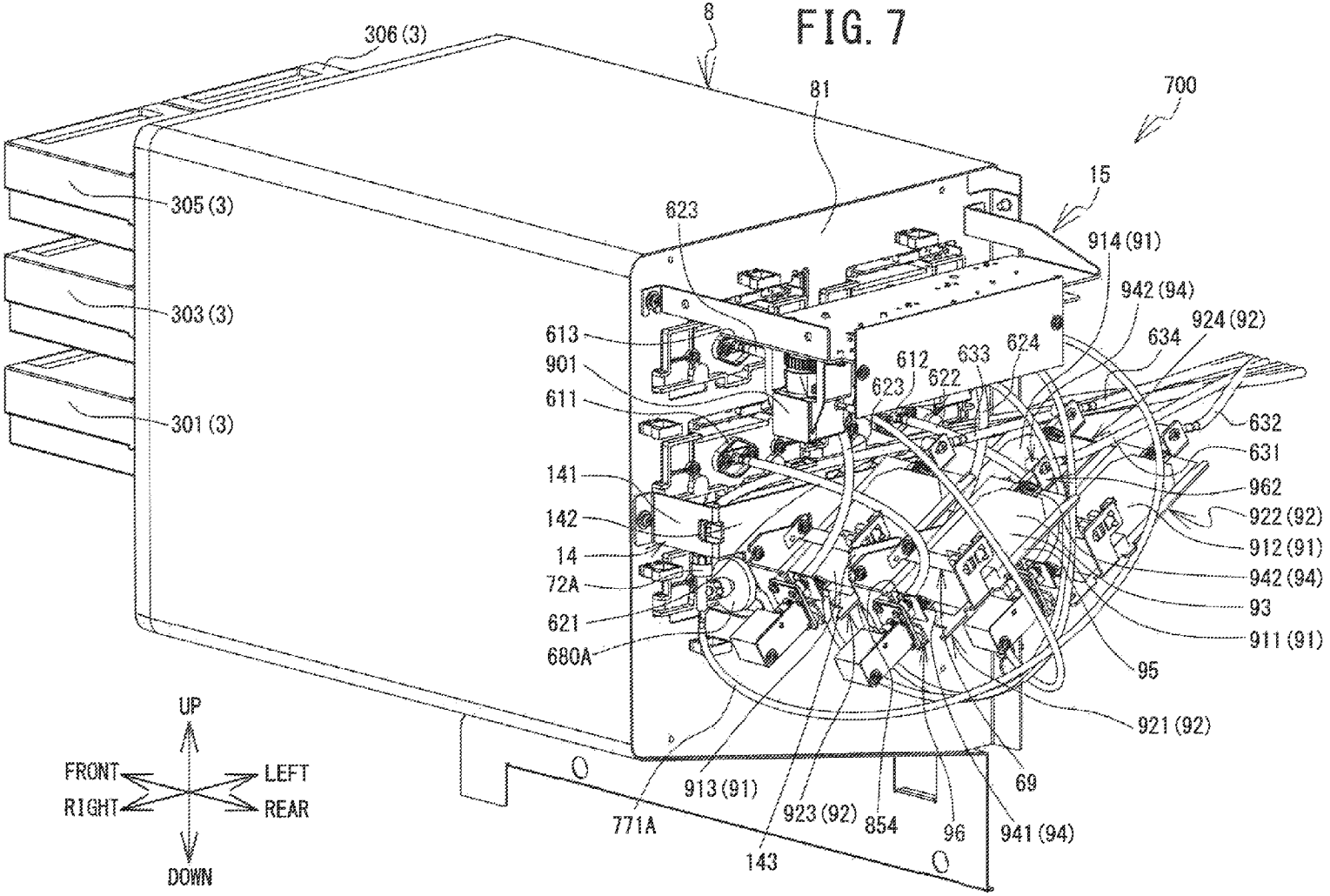
FIG. 7 is a perspective view of the mount frame portion and the ink passage.
Figure 8:
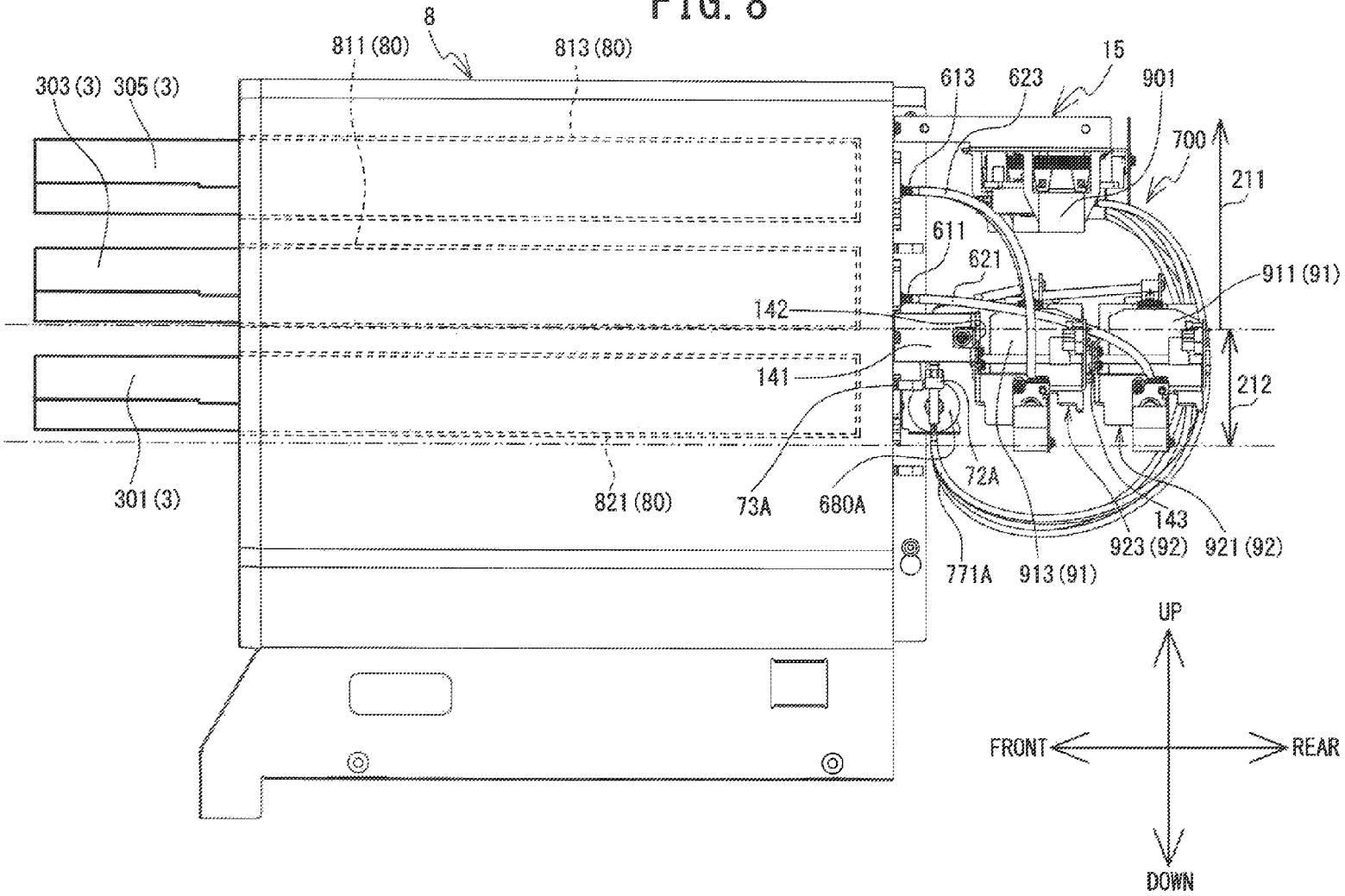
FIG. 8 is a right side view of the mount frame portion and the ink passage.

As shown in FIG. 7 and FIG. 8, four sub-tanks 91 and four sub-tank supports 92 are provided behind the mount frame portion 8. The sub-tanks 91 and the sub-tank supports 92 are located such that they face the second mount portions 821 and 822 in the horizontal direction. As shown in FIG. 2, FIG. 3 and FIG. 8, the sub-tanks 91 are located in the second region 212. FIG. 2 and FIG. 3 schematically show the positions of the respective members of the flow passage of the ink 97 in the up-down direction. The directions of the sub-tank(s) 91 and the sub-tank support(s) 92 may be different from the directions shown in FIG. 7. The sub-tanks 91 define reservoir passages 711-714, which will be described later (see FIG. 2 and FIG. 3), and can reserve the ink 97 to be supplied to the nozzle face 111 from the cartridge 3.

The structure of the sub-tank 91 will be described in detail. In the following description, the top side, the bottom side, the upper left side, the lower right side, the lower left side, and the upper right side in FIG. 9 respectively correspond to the top side, the bottom side, the front side, the rear side, the right side, and the left side of the sub-tank 91, respectively.

Figure 9:
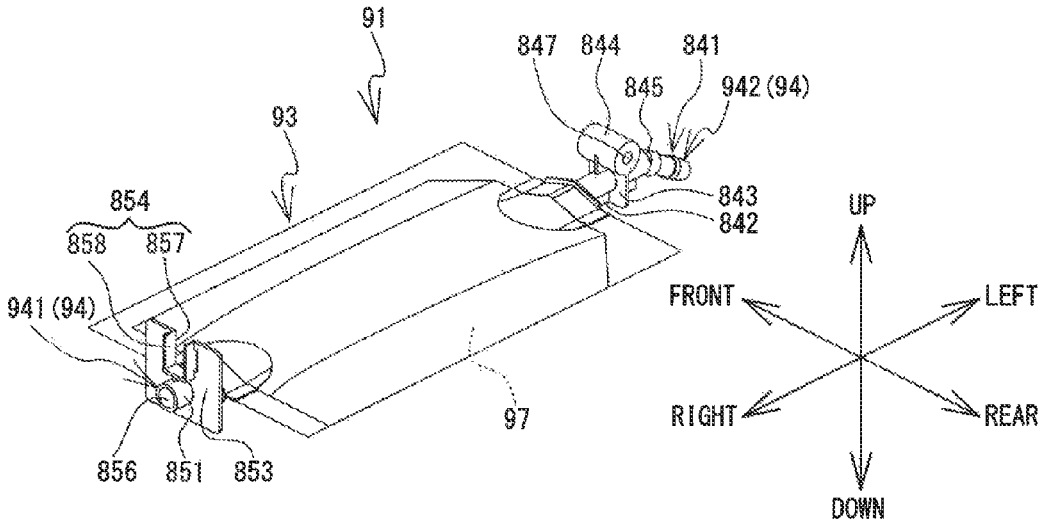
FIG. 9 is a perspective view of a sub-tank.
Figure 10:
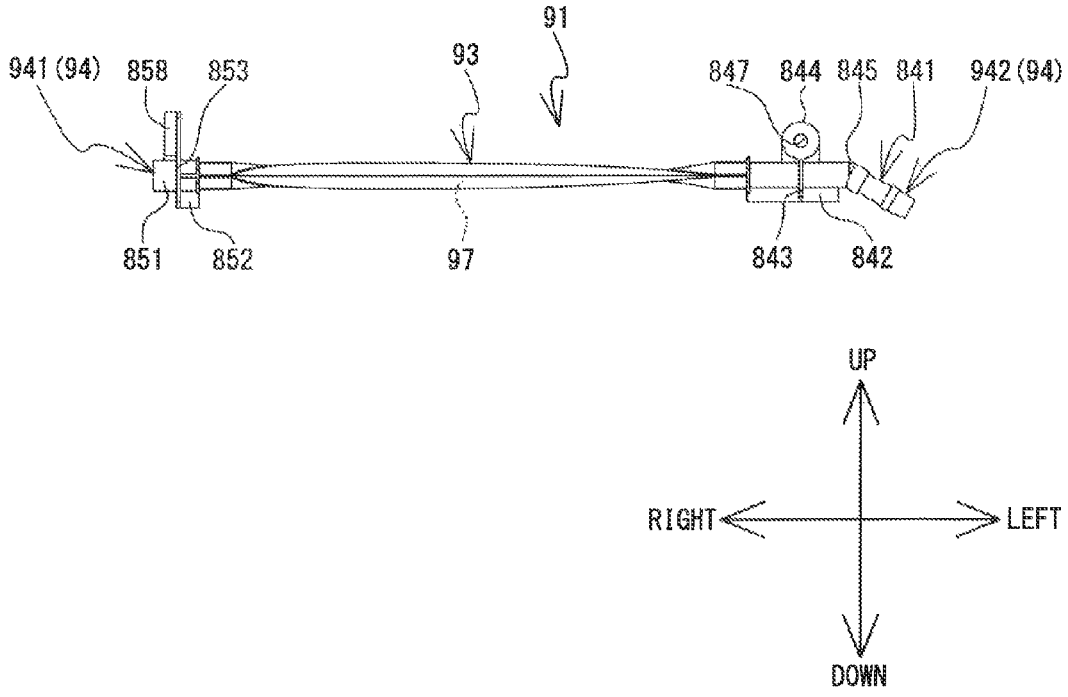
FIG. 10 is a rear view of the sub-tank.

As shown in FIG. 9 and FIG. 10, the sub-tank 91 is provided with a bag portion 93 and a mouth plug 94. The bag portion 93 is capable of internally containing the liquid ink 97. The bag portion 93 has the rectangular shape, when viewed from the top, with the right-left direction being the longitudinal direction. As shown in FIG. 7, each of the sub-tanks 91 is inclined relative to the horizontal direction, with the left side being higher than the right side. In FIG. 7, the reference numerals of the bag portion 93 and the mouth plug 94 are shown only with respect to the sub-tank 911, which will be described later.

The mouth plugs 94 can allow the ink 97 to flow into and out of the sub-tank 91. The mouth plugs 94 include a flow inlet 941 and a flow outlet 942. As shown in FIG. 7 and FIG. 9, the flow inlet 941 is provided at the right end of the bag portion 93, and allows the ink 97 to flow into the bag portion 93. The flow outlet 942 is provided at the left end of the bag portion 93, and allows the ink 97 to flow out of the bag portion 93. As illustrated in FIG. 7, the flow outlet 942 is situated above the flow inlet 941 when viewed in the up-down direction.

As shown in FIG. 9 and FIG. 10, each of the bag portions 93 is a pouch-like container that is prepared by folding a single flexible rectangular film, which is made from synthetic resin, and joining the peripheral portions thereof to each other by thermal adhesion (i.e., heat seal). The flow outlet 942 has a cylindrical portion 841, a first plate portion 842, a second plate portion 843 and a mouth plug fixture 844. A right part of the cylindrical portion 841 is inserted into inside the bag portion 93 through between the films at the left end of the bag portion 93. The cylindrical portion 841 extends to the left, and bends to the lower left direction at a bending portion 845. The ink 97 flows inside a hole portion 846 (see FIG. 14), which is formed inside the cylindrical portion 841. The first plate portion 842 protrudes downward from a right part of the bending portion 845 of the cylindrical portion 841. The first plate portion 842 extends in the right-left direction.

The second plate portion 843 extends in the up-down direction and front-rear direction from a part of the cylindrical portion 841 which is present on the right of the bending portion 845. In the up and down direction, a lower end of the second plate portion 843 is situated at the same position as level to the lower end of the first plate portion 842. The lower end of the first plate portion 842 and the lower end of the second plate portion 843 serve in combination as a support element to support the flow outlet 942 when the sub-tank 91 is mounted in the sub-tank support 92. The mouth plug fixture 844 that extends in the front-rear direction and has a cylindrical shape is connected to the upper end of the second plate portion 843. A screw hole 847 that extends in the front-rear direction is formed in a rear part of the mouth plug fixture 844 (see FIG. 9).

The flow inlet 941 has a cylindrical portion 851, a first plate portion 852, a second plate portion 853, and an engagement portion 854. A left part of the cylindrical portion 851 is inserted into inside the bag portion 93 through between the films at the right end of the bag portion 93. The cylindrical portion 851 extends to the right. The ink 97 flows in a hole portion 856, which is formed inside the cylindrical portion 851 (see FIG. 9). The first plate portion 852 (see FIG. 10) protrudes downward from the cylindrical portion 851. The first plate portion 852 extends in the left direction from the center part in the left and right direction of the cylinder portion 851.

The second plate portion 853 extends in the up-down direction and in the front-rear direction from the center part of the cylinder portion 851 in the right-left direction. In the up-down direction, the lower end of the second plate portion 853 is situated at the same position as the lower end of the first plate portion 852. The second plate portion 853 is connected to the right end of the first plate portion 852 (see FIG. 10).

As shown in FIG. 9, a recess portion 857 is provided in the center part in the front-rear direction at an upper end of the second plate portion 853. The recess portion 857 is recessed downward in a rectangular shape. A wall portion 858 protrudes in the right direction along the recess portion 857. The engagement portion 854 is formed with the recess portion 857 and the wall portion 858. The engagement portion 854 is a portion configured to engage with an outer face of an associated flow-in passage 621, 622, 623, 624 (see FIG. 7 and FIG. 11; will be described later).

Figure 11:
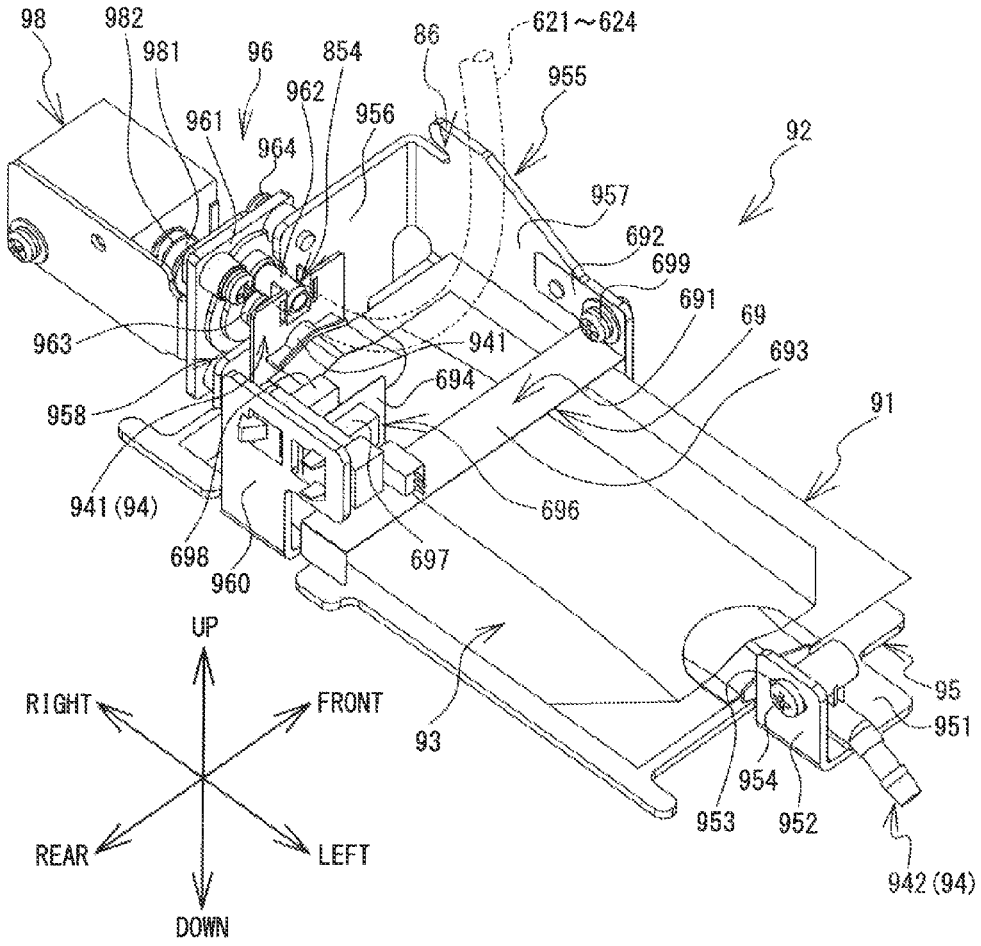
FIG. 11 is a perspective view of a sub-tank support that supports the sub-tank.

Hereinafter, the configuration of the sub-tank support 92 will be described in detail. In the following description, the top side, the bottom side, the upper right side, the lower left side, the upper left side, and the lower right side in FIG. 11 respectively correspond to top side, the bottom side, the upper right side, the lower left side, the upper left side, and the lower right side of the sub-tank support 92. The sub-tank support 92 is a member to support the sub-tank 91. As shown in FIG. 7 and FIG. 11, the sub-tank support 92 has a support plate portion 95, a valve portion 96 and a detection portion 69. In FIG. 7, the reference numerals for the support plate portions 95, the valve portions 96 and the detection portions 69 are only depicted in connection with a sub-tank support 921, which will be described below.

As shown in FIG. 11, the support plate portion 95 is a plate-like shaped member and supports the sub-tank 91 on the upper face side thereof. A protrusion portion 951 protruding in the left direction is provided in the center part in the front-rear direction at the left end part of the support plate portion 95. The upper face of the protrusion portion 951 contacts the first plate portion 842 and the second plate portion 843 (see FIG. 10) which form the lower end of the flow outlet 942, and supports the flow outlet 942. A wall portion 952 extending upward is provided at the rear end part of the protrusion portion 951. The wall portion 952 has a hole 953 that penetrates in the front-rear direction. A head part of the screw 954 is located at the rear side of the hole 953, and a shaft part of the screw 954 is inserted into the hole 953. The shaft portion of the screw 954 is fastened to the screw hole 847 (see FIG. 10) of the flow outlet 942. With this configuration, the flow outlet 942 is secured (fixed) to the sub-tank support portion 92.

A wall portion 955 is erected upward at the right front part of the support plate portion 95. The wall portion 955 has a first wall portion 956 extending in the front-rear direction along the right end of the support plate portion 95 and a second wall portion 957 extending in the right-left direction along the front end of the support plate portion 95. The rear end of the first wall portion 956 is situated at the front side with respect to the read end of the support plate portion 95. A cutout portion 958, which is cutout downward in the first wall portion 956, is formed at the rear part of the first wall portion 956.

The upper end of the second wall portion 957 is inclined such that the upper end of the second wall portion 957 is situated to progress lower towards the left side direction. A fixation portion 86 is provided at the upper right end part of the second wall portion 957. The fixation portion 86 is formed as the right end of the second wall portion 957 is recessed to the left. The fixation portion 86 is a portion for securing the sub-tank support 92 onto the support plate portion 14 with a screw (see FIG. 7).

Each of the valve portions 96 is provided on the right of the associated support plate portion 95. The valve portions 96 are provided for the reservoir passages 711-714 (see FIG. 2 and FIG. 3; will be described later), respectively, to open and close the reservoir passages 711-714. For example, each of the valve portions 96 is connected to corresponding one of flow-in passages 621-624, which will be described later, and corresponding one of the flow inlets 941 to open and close the flow passage between the corresponding one of the flow-in passages 621-624 and the corresponding one of the flow-in inlets 941.

The valve portion 96 includes a flow passage formation portion 961, a first connection port member 962, a second connection port member 963 and a solenoid 98. The flow passage formation portion 961 has a rectangular shape, when viewed from the left side face. The upper front part and the lower rear part of the flow passage formation portion 961 are coupled to the circumferential parts of the cutout portion 958 in the first wall portion 956, respectively, with the screws 964 and 965 (see FIG. 12). With this configuration, the valve portion 96 is supported by the wall portion 955.

The first connection port member 962 has a cylindrical shape which protrudes in the left direction from the left face of the flow passage formation portion 961. The left end part of the first connection port member 962 is located in the engagement portion 854 provided at the flow inlet 941. The first connection port member 962 is connected to the associated flow-in passage 621, 622, 623, 624. The engagement portion 854 engages with the outer face of the associated flow-in passage 621, 622, 623, 624 at the periphery of the first connection port member 962 (see FIG. 7 and FIG. 11).

Figure 12:
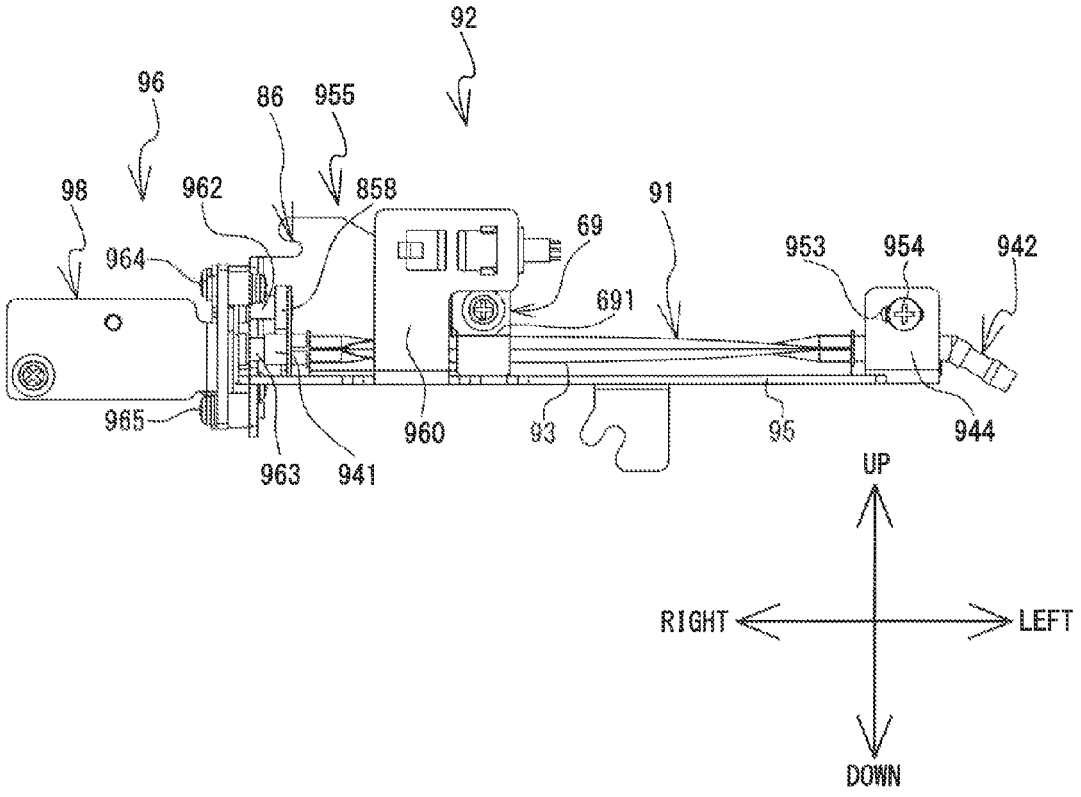
FIG. 12 is a rear view of the sub-tank support that supports the sub-tank.
Figure 13:
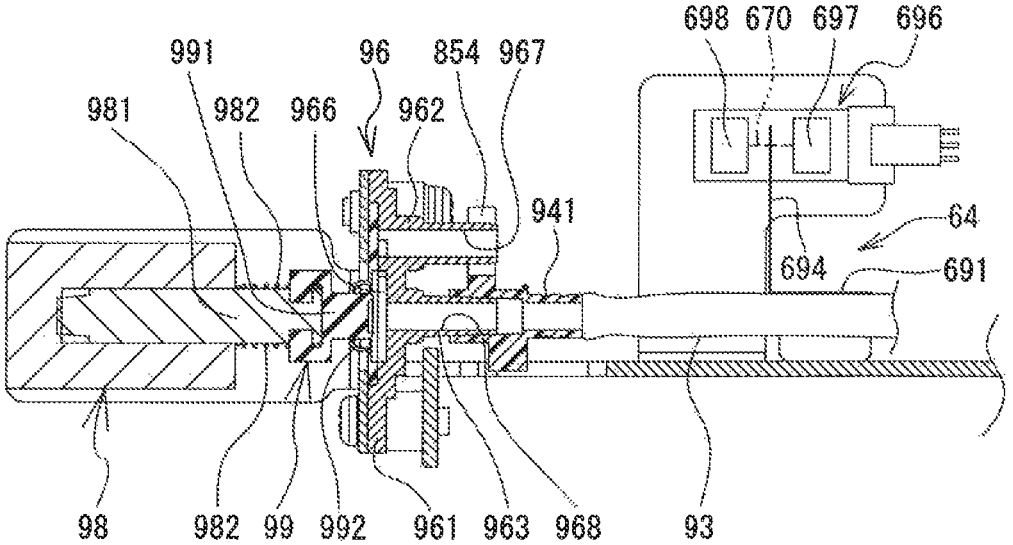
FIG. 13 is an enlarged vertical cross-sectional view of major components of the sub-tank support that supports the sub-tank.
Figure 13:
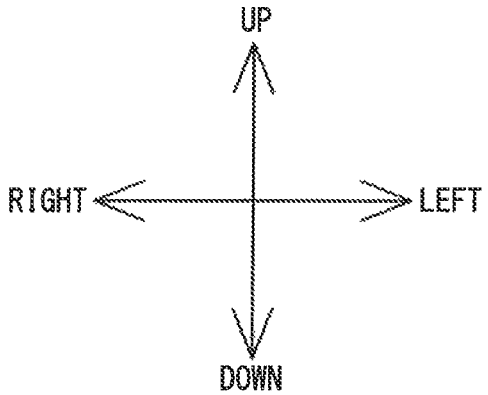

As illustrated in FIG. 11 to FIG. 13, the second connection port member 963 is located below the first connection port member 962. The second connection port member 963 has a cylindrical shape protruding in the left direction from the left face of the flow passage forming portion 961. The second connection port member 963 is connected to the flow inlet 941. As shown in FIG. 13, at the right part of the flow passage formation portion 961, a flow passage 966 is formed which connect a flow passage 967 in the first connection port 962 to a flow passage 968 in the second connection port 963.

As illustrated in FIG. 11 and FIG. 13, the solenoid 98 is located at the right side of the valve portion 96. The solenoid 98 includes a movable shaft 981 extending in the left direction. A coil spring 982 is located in the vicinity of the movable shaft 981. The solenoid 98, under the control of a CPU 40 (see FIG. 18), is switched between an energizing state and a non-energizing state. The energizing state allows the movable shaft 981 to move in the right direction against the biasing force of the coil spring 982. The non-energizing state allows the movable shaft 981 to move in the left direction by the biasing force of the coil spring 982.

As shown in FIG. 13, an open-close member 99 is coupled to a front edge part of the movable shaft 981. The open-close member 99 includes an open-close shaft 991 and a covering portion 992. The open-close shaft 991 is provided at the left end part of the open-close member 99, and has a cylindrical shape extending in the left direction. The open-close shaft 991 is located at the right side of the second connection port 963. The diameter of the open-close shaft 991 is larger than the diameter of the flow passage 968 of the second connection port 963. When the movable shaft 981 moves in the left direction, the open-close shaft 991 closes the flow passage 968 of the second connection port 963. Thus, the flow passage 966 is closed and the ink 97 is barred from flowing. On the other hand, when the movable shaft 981 moves in the right direction, the open-close shaft 991 opens the flow passage 968 of the second connection port 963. Thus, the flow passage 966 is opened and the ink 97 starts to flow.

The covering portion 992 extends outwardly in the radial direction from somewhat right side of the left end of the open-close shaft 991, and is connected to the circumferential part of the flow passage 966 of the flow passage formation portion 961. In other words, the covering portion 992 covers the flow passage formation portion 961. The covering portion 992 has the resilient property and warp in following the movement of the movable shaft 981 in the right-left direction.

As shown in FIG. 11, a wall portion 960 is erected upwardly at the right part of the rear end part of the support plate portion 95. The detection portion 69 includes a remaining amount detection plate 691 and an optical detection portion 696. The optical detection portion 696 is located at the front face of the wall portion 960. The optical detection portion 696 includes a light emitting portion 697 and a light receiving portion 698. The light emitting portion 697 and the light receiving portion 698 are distant each other in the right-left direction. The light detecting portion 696 is electrically connected to the CPU 40 via the detecting circuit 191 (see FIG. 17).

Figure 14:
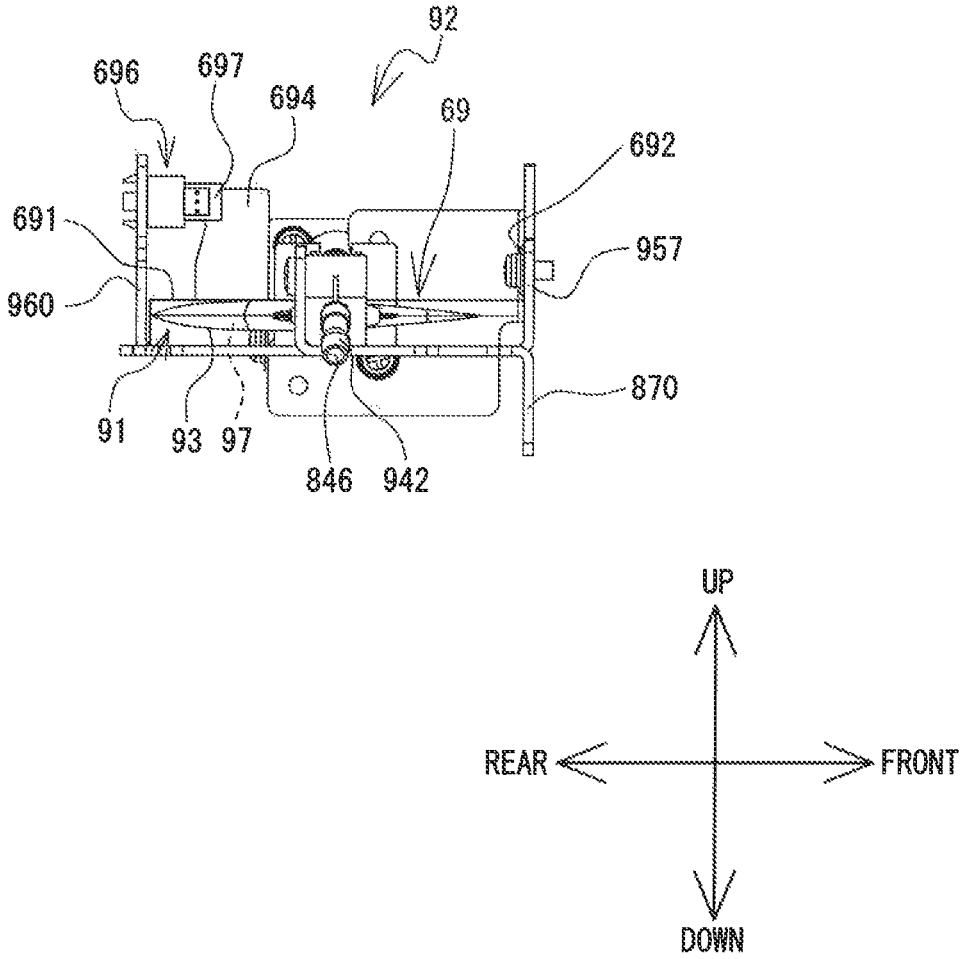
FIG. 14 is a left side view of the sub-tank support that supports the sub-tank.
Figure 15:
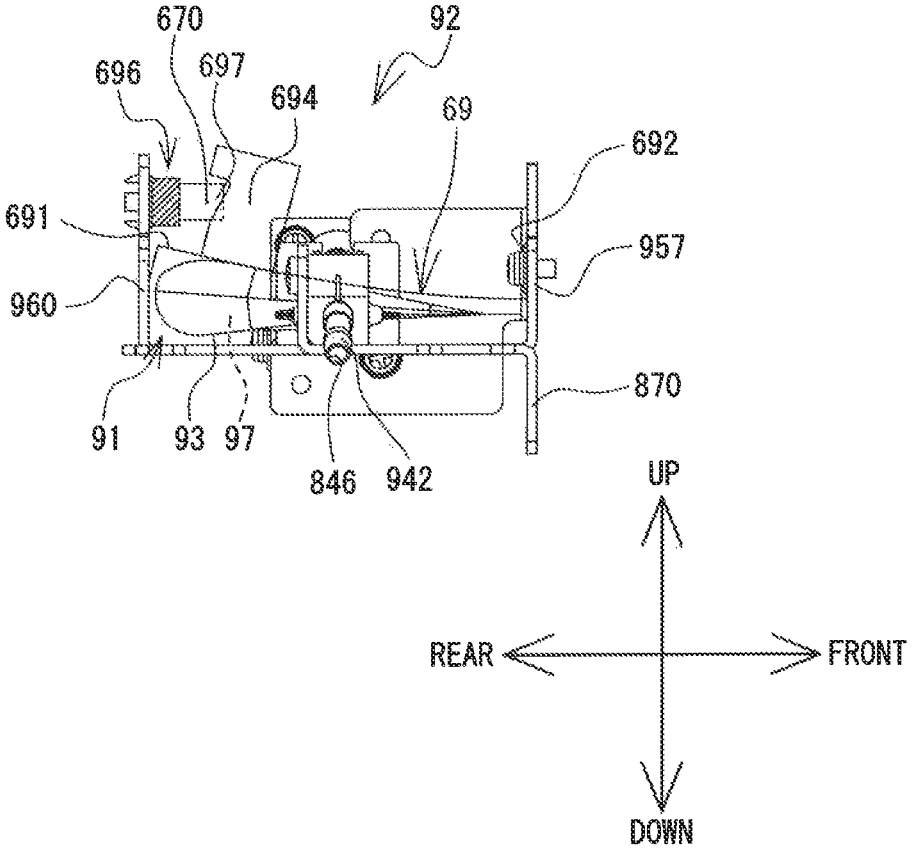
FIG. 15 is a left side view of the sub-tank support that supports the sub-tank when a bag portion of the sub-tank becomes thicker from the condition shown in FIG. 14.

The remaining amount detection plate 691 is capable of abutting the upper face of the bag portion 93 of the sub-tank 91, and is displaceable in accordance with the thickness of the bag portion 93 which varies in accordance with the remaining amount of the ink 97 (see FIG. 14 and FIG. 15). The remaining amount detection plate 691 includes a fixed plate portion 692, an elongated plate portion 693 and a shielding plate portion 694. The fixed plate portion 692 is located at the rear face at the upper end part of the left end part of the second wall portion 957. The fixed plate portion 692 is secured to the second wall portion 957 with the screw 699 so that the remaining amount detection plate 691 is secured to the sub-tank support portion 92.

The elongated plate portion 693 extends backward from the lower end of the fixed plate portion 692. The rear end part of the elongated plate portion 693 bends downwardly. The elongated plate portion 693 is a portion configured to abut the upper face of the bag portion 93. The shielding plate portion 694 extends upward from the rear end of the elongated plate portion 693. An upper part of the shielding plate portion 694 (the upper end of the shielding plate portion 694 in this embodiment) protrudes to the rear, and is located between the light emitting element 697 and the light receiving element 698 of the light detecting portion 696. As the thickness of the bag portion 93 changes with a remaining amount of the ink 97 in the bag portion 93, the elongated plate portion 693 is displaced in the up-down direction, and the shielding plate portion 694 moves in the up-down direction. For example, as shown in FIG. 11, FIG. 13 and FIG. 14, the upper part of the shielding plate portion 694 is present on an optical path 670 between the light emitting element 697 and the light receiving element 698 (see FIG. 13 and FIG. 15) when the thickness of the bag portion 93 is equal to or smaller than a predetermined thickness. Thus, the upper part of the shielding plate portion 694 shields the light from the light emitting element 697, and therefore the light from the light emitting element 697 is not received by the light receiving element 698. As shown in FIG. 15, on the other hand, when the thickness of the bag portion 93 is greater than the predetermined thickness, the upper part of the shielding plate portion 694 moves above the optical path 670 between the light emitting element 697 and the light receiving element 698. Thus, the upper part of the shielding plate portion 694 does not shield the light from the light emitting element 697, and therefore the light from the light emitting element 697 is received by the light receiving element 698. The CPU 40 detects whether or not the light is received by the light receiving element 698, and determines the thickness of the bag portion 93.

Figure 16:
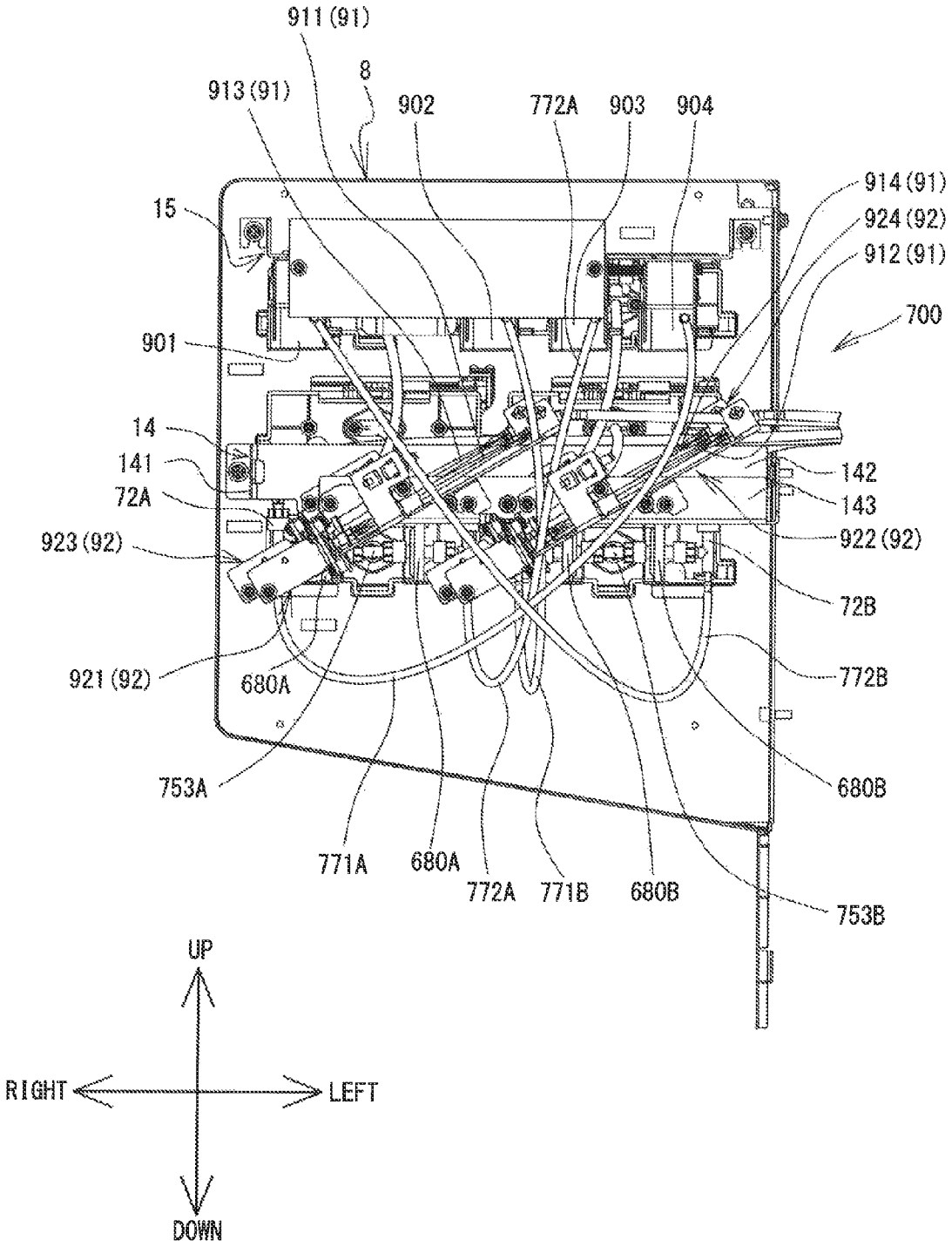
FIG. 16 is a rear view of the mount frame portion and the ink passages.

As shown in FIG. 7, FIG. 8 and FIG. 16, the rear face 81 of the mount frame portion 8 is provided with the support plate portion 14. The support plate portion 14 supports the sub-tank support portion 92. The support plate portion 14 includes a first plate portion 141, a second plate portion 142, and a third plate portion 143. The first plate portion 141 extends backward from a position, the position being between the upper mount portions 811 and 812 and the lower mount portions 821 and 822 in the up and down direction, and being the right end part of the rear face 81 of the mount frame portion 8 in the right and left direction. The second plate portion 142 is connected to the rear end of the first plate portion 141 and extends in the right and left direction. Thus, the second plate portion 142 is situated in the rear direction of the mount frame portion 8. The third plate portion 143 extends in the right and left direction at the rear side of the second plate portion 142. The lower end of the right part of the third plate portion 143 is connected to the lower end of the right part of the second plate portion 142 with the plate portion extending in the front and rear direction (not shown). The left end part of the support plate portion 14 is supported by the frame member (not shown).

The four sub-tank supports 92 and the four sub-tanks 91 are arranged in two columns side by side in the right-left direction and in two tiers in the front-rear direction. The four sub-tanks 91 are assigned reference numerals 911, 912, 913 and 914, respectively (i.e., sub-tanks 911-914), in the following description. The four sub-tank supports 92 for supporting the four sub-tanks 911-914 are assigned reference numerals 921, 922, 923 and 924 (sub-tank supports 921-924), respectively.

As shown in FIG. 7, the sub-tank 913 and the sub-tank support 923 are situated behind the lower mount portion 821 (see FIG. 6). The sub-tank 914 and the sub-tank support 924 are situated behind the lower mount portion 822 (see FIG. 6). The sub-tank supports 923 and 924 connect to the second plate portion 142 of the support plate 14.

The sub-tank 911 and the sub-tank support 921 are situated behind the sub-tank 913 and the sub-tank support 923. The sub-tank 912 and the sub-tank support 922 are situated behind the sub-tank 914 and the sub-tank support 924. The third plate portion 143 of the support plate 14 is situated behind the sub-tank supports 923 and 924. The sub-tank supports 921 and 922 connect to the third plate 143, respectively. The sub-tank 91 and the sub-tank support 92 incline to the diagonally upward left direction relative to the horizontal plane.

As shown in FIG. 7 and FIG. 16, the sub-tanks 911 and 912 aligned in the right-left direction, out of a plurality of sub-tanks 91, are inclined such that a part of each of the sub-tanks 911 and 912 is located to progress upward towards the left direction, and the sub-tanks 911 and 912 are partially overwrapped each other in the up and down direction. Thus, the left part of the sub-tank 911 is located at the upper side of the right part of the sub-tank 912. Likewise, the sub-tanks 913 and 914 aligned in the right-left direction, out of a plurality of sub-tanks 91, are inclined such that a part of each of the sub-tanks 913 and 914 are located to progress upward towards the left direction, and the sub-tanks 913 and 914 are partially overwrapped each other in the up and down direction. Thus, the left part of the sub-tank 913 is situated at the upper side of the right part of the sub-tank 914.

A pump support portion 15 is provided towards the rear side from the rear face 81 of the mount frame portion 8. The pump support portion 15 is configured to support the pumps 901 to 904 (see FIG. 16). As shown in FIG. 16, four pumps 901 to 904 are aligned from the right side toward the left direction. In FIG. 16, an illustration of the flow passage is omitted that connects the pumps 901 to 904 to the head portion 110.

The ink passage arrangement 700 will be described. As shown in FIG. 2 and FIG. 3, the ink passage arrangement 700 has reservoir passages 711-714 and non-reservoir passages 72A, 72B. FIG. 2 illustrates the fluid passages which are connected to the upper mount portions 811 and 813 and the lower mount portion 821 on the right column in FIG. 6. FIG. 3 illustrates the fluid passages which are connected to the upper mount portions 812 and 814 and the lower mount portion 822 on the left column in FIG. 6.

The reservoir passages 711 to 714 are the flow passages that connect the upper mount portions 811 to 814 to the head portion 110 of the head unit 200, respectively, and that have sub-tanks 911 to 914. The reservoir passages 711 to 714 are flow passages that flow the color ink. The non-reservoir passages 72A and 72B are the flow passages that connect the lower mount portions 821 and 822 to the head portion 110 of the head unit 100, respectively, and that have no sub-tanks 911 to 914. The non-reservoir passages 72A and 72B are the flow passages that flow the white ink.

The reservoir passages 711-714 will now be described. The reservoir passages 711-714 include fluid feed ports 611-614, flow-in passages 621-624, flow-out passages 631-634, and sub-tanks 911-914, respectively. The fluid feed ports 611-614 are provided behind the upper mount portions 811-814 at the rear face 81 of the mount frame portion 8, respectively. The fluid feed ports 611-614 connect to the hollow needles (not shown) provided in the upper mount portions 811-814 via fluid passages (not shown), respectively. The fluid feed ports 611-614 feed the ink 97 to the head portion 110 from the upper mount portions 811-814.

As shown in FIG. 2, FIG. 3 and FIG. 7, one end of each of the flow-in passages 621 to 624 is connected to the corresponding one of the fluid feed ports 611 to 614, respectively. The flow-in passages 621 to 624 extend towards the sub-tanks 911 to 914 provided in the second region 212, respectively. As shown in FIG. 2, FIG. 7 and FIG. 8, the flow-in connection passage 621 is the flow passage that connects one of the upper mount portions 811 (see, FIG. 2) to one of the sub-tanks 911. The flow-in passage 623 is a flow passage that connects the upper mount portion 813 (see FIG. 2), which is located at the upper side of one of the upper mount portions 811, to the sub-tank 913, which is located at the closer position to the mount portion 80 than one of the sub-tank 911 in the horizontal direction. The flow-in connection passage 621 has the same length as the flow-in connection passage 623.

As shown in FIG. 3 and FIG. 7, the flow-in passage 622 is a flow passage that connects one of the upper mount portion 812 (see FIG. 3) to one of the sub-tanks 912. The flow-in passage 624 is a flow passage that connects the upper mount portion 814 (see FIG. 3), which is located at the upper side of one of the upper mount portion 812 to the sub-tank 914, which is located at the closer position to the mount portion 80 than one of the sub-tanks 912 in the horizontal direction. The flow-in passage 622 has the same length as the flow-in passage 624.

As shown in FIG. 11, the other end of each of the flow-in passages 621 to 624 is connected to the corresponding one of the first connection port members 962 of the valve portions 96 of the sub-tank support portions 921 to 924, respectively. The flow inlets 941 of the sub-tanks 911 to 914 are connected to the second connection port members 963 of the valve portions 96 (see FIG. 12), respectively. Thus, the flow-in passages 621 to 624 are linked to the flow inlets 941 of the sub-tanks 911 to 914.

As shown in FIG. 2, FIG. 3 and FIG. 7, one end of each of the flow-out passages 631 to 634 is linked to the corresponding one of the flow outlets 942 of the sub-tanks 911 to 914, respectively. The other end of each of the flow-out passages 631 to 634 is connected to the head portion 110 of the head unit 200, and linked to the nozzle arrays 121 to 124 of the nozzle face 111 (see FIG. 2 and FIG. 3).

Hereinafter, the non-reservoir passages 72A and 72B will be described below. As shown in FIG. 2, non-reservoir passage 72A is provided with a fluid feed port 73A, a branch portion 753A, and two filter portions 680A. As shown in FIG. 2 and FIG. 8, the fluid feed port 73A is provided at the rear side of the lower mount portion 821 on the rear face 81 of the mount frame portion 8. The fluid feed port 73A is connected to the hollow needle provided at the lower mount portion 821 through the flow passage (not shown). The fluid feed port 73A supplies the ink 97 to the head portion 110 side from the lower mount portion 821.

As shown in FIG. 2, the non-reservoir passage 72A extends from the fluid feed port 73A, branches into two flow passages at the branch portion 753A, and is connected, through the filter portion 680A, to the nozzle arrays 121 and 122 of the head unit 100. The filter portion 680A has a disk-like shape so as to reduce the possibility that the extraneous substance immixed into the ink 97 would flow to the downstream side. Circulation passages 771A and 772A are connected to the downstream side of the filter portion 680A of the two flow passages into which the non-reservoir passage 72A is branched. The circulation passages 771A and 772A are provided with the pumps 904 and 903, respectively.

As shown in FIG. 3, the non-reservoir passage 72B includes a fluid feed port 73B, a branch portion 753B and two filter portions 680B. The non-reservoir passage 72B is connected to circulation passages 771B and 772B. As those configuration are similar to the fluid feed port 73A, the branch portion 753A, two filter portions 680A, and circulation passages 771A and 772A, the description will be omitted. The fluid feed port 73B supplies the ink 97 to the head portion 110 side from the lower mount portion 822. The non-reservoir passage 72B is connected to the nozzle arrays 123 and 124 of the head unit 100. The circulation passages 771B and 772B are provided with the pumps 902 and 901, respectively.

The flow of the ink 97 during the printing operation and the circulating operation will be described. The ink 97 is injected from the nozzle face 111 to carry out the printing process, and the white ink is circulated upon activation of the pumps 901-904 to carry out the circulating process. The printing process and the circulating process are carried out when the CPU 40 of the printer 1 controls the printer 1 in accordance with the control program stored in the ROM 41 (see FIG. 17).

As shown in an enlarged view W1 in FIG. 2, during the printing operation, a piezoelectric elements (not shown) provided at the head portion 110 are activated, and the ink 97 is injected from the nozzle 113 of the nozzle face 111. The operation injecting the ink 97 from the nozzle 113 serves as a pump which pulls the ink 97 towards the nozzle face 111 side. Thus, as shown in FIG. 2, the white ink is supplied, through the non-reservoir passage 72A, from the cartridge 301 to the nozzle arrays 121 and 122 of the head unit 100. Further, as shown in FIG. 3, the white ink is supplied, through the non-reservoir passage 72B, from the cartridge 302 to the nozzle arrays 123 and 124 of the head unit 100.

As shown in FIG. 2 and FIG. 3, the color ink is supplied to the nozzle arrays 121-124 of the head unit 200 from the cartridges 303-306 via the flow-in passages 621-624, the valve portions 96 (see FIG. 11), the sub-tanks 911-914 and the flow-out passages 631-634. When the valve portions 96 are closed, the color ink is supplied to the nozzle arrays 121-124 of the head unit 200 from the sub-tanks 911-914 via the flow-in passages 631-634. Because the pumps 901-904 are not activated during the printing process, the white ink does not flow from the circulation passages 771A, 772A, 771B and 772B. As shown in FIG. 2 and FIG. 3, the color ink are supplied from the cartridges 303 to 306 to the nozzle arrays 121 to 124 of the head unit 200, respectively, through the flow-in passages 621 to 624, the valve portion 96 (see FIG. 11), the sub-tanks 911 to 914, and the flow-out passages 631 to 634. When the valve portion 96 is closed, the color ink is supplied from the sub-tanks 911 to 914 to the nozzle arrays 121 to 124 of the head unit 200 through the flow-out passages 631 to 634. During the printing operation, as the pumps 901 to 904 are not activated, the white ink in the circulation passages 771A, 772A, 771B, and 772B does not flow.

As shown in an enlarged view W2 in FIG. 2, when the printing is finished, the meniscus is created on the nozzle face 111 that causes the ink 97 to be recessed inward inside the nozzle 113 due to the surface tension. The meniscus allows the ink 97 to be held on the nozzle face 111.

Hereinafter, the circulating operation will be described. The pumps 901 to 904 are activated to carry out the circulating process under the control of the CPU 40 while the printing process is not carried out. The ink 97 is not injected from the nozzle 113 while the printing process is not carried out. Once the circulating process is performed, as shown with the arrow 90 in the FIG. 2 and FIG. 3, the ink 97 in the non-reservoir passages 72A and 72B are circulated through the circulation passages 771A, 772A, 771B and 771B. As a result, the white ink is stirred that is a high precipitation liquid.

Figure 17:
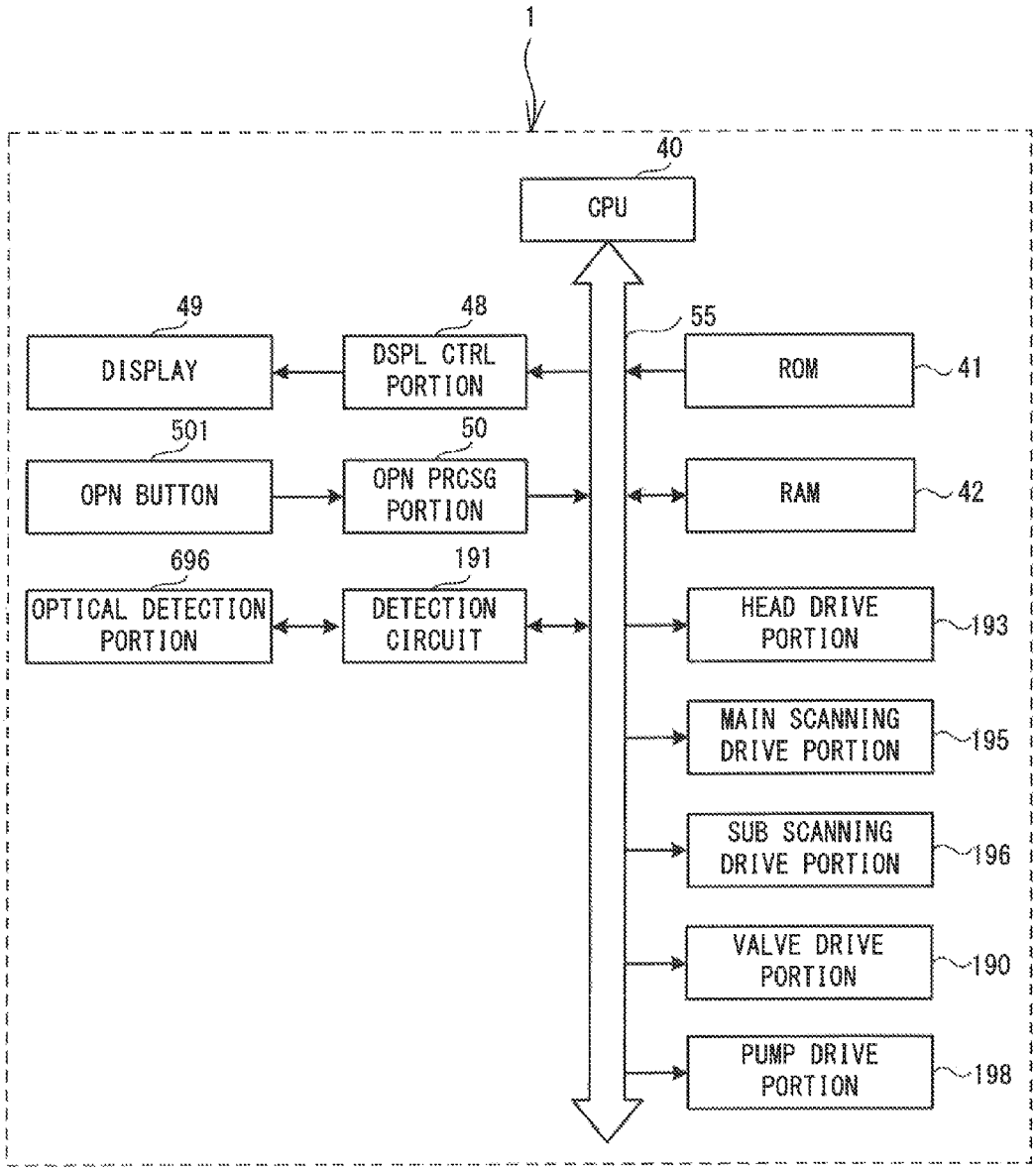
FIG. 17 is a block diagram showing an electrical configuration of the printer.

Referring now to FIG. 17, the electrical configuration of the printer 1 will be described. The printer 1 includes the CPU 40 to control the printer 1. The ROM 41, the RAM 42, a head drive portion 193, a main scanning drive portion 195, a sub scanning drive portion 196, a valve drive portion 190, a pump drive portion 198, a display control portion 48, and an operation processing portion 50 are electrically connected to the CPU 40 via a bus 55. It should be noted that the CPU 40, the ROM 41 and other components may be replaced with an ASIC.

The ROM 41 stores the control program, which is used by the CPU 40 to control the operation of the printer 1, together with initial values and other data and information. The RAM 42 temporarily stores various data used by the control program. The head drive portion 193 is electrically connected to the head portion 110 that injects the ink 97, and drives piezo-electric elements disposed at respective injection channels of the head portion 110 (see FIG. 3). Thus, the head drive portion 193 causes the nozzle to inject the ink 97.

The main scanning drive portion 195 includes a drive motor 19 (see FIG. 1), and causes the carriage 20 to move in the right-left direction (main scanning direction). The sub scanning drive portion 196 includes a motor, a timing belt and other components which are not shown, and drives the platen drive mechanism 6 (see FIG. 1). Thus, the sub scanning drive portion 196 causes the platen 5 (see FIG. 1) to move in the front-rear direction (sub scanning direction).

The valve drive portion 190 drives the solenoid 98 of the valve portion 96 at each of the sub-tank supports 921-924. The CPU 40 controls the valve portion 96 through the valve drive portion 190 to open and close the flow-in passage 621, 622, 623, 624 of the reservoir passage 711, 712, 713, 714. The pump drive portion 198 drives the pumps 901-904. The display controller 48 controls the displaying manner and contents to be displayed on the display 49. The operation processing portion 50 sends an entered instruction and data, which are entered from the operation button 501, to the CPU 40.

Figure 18:
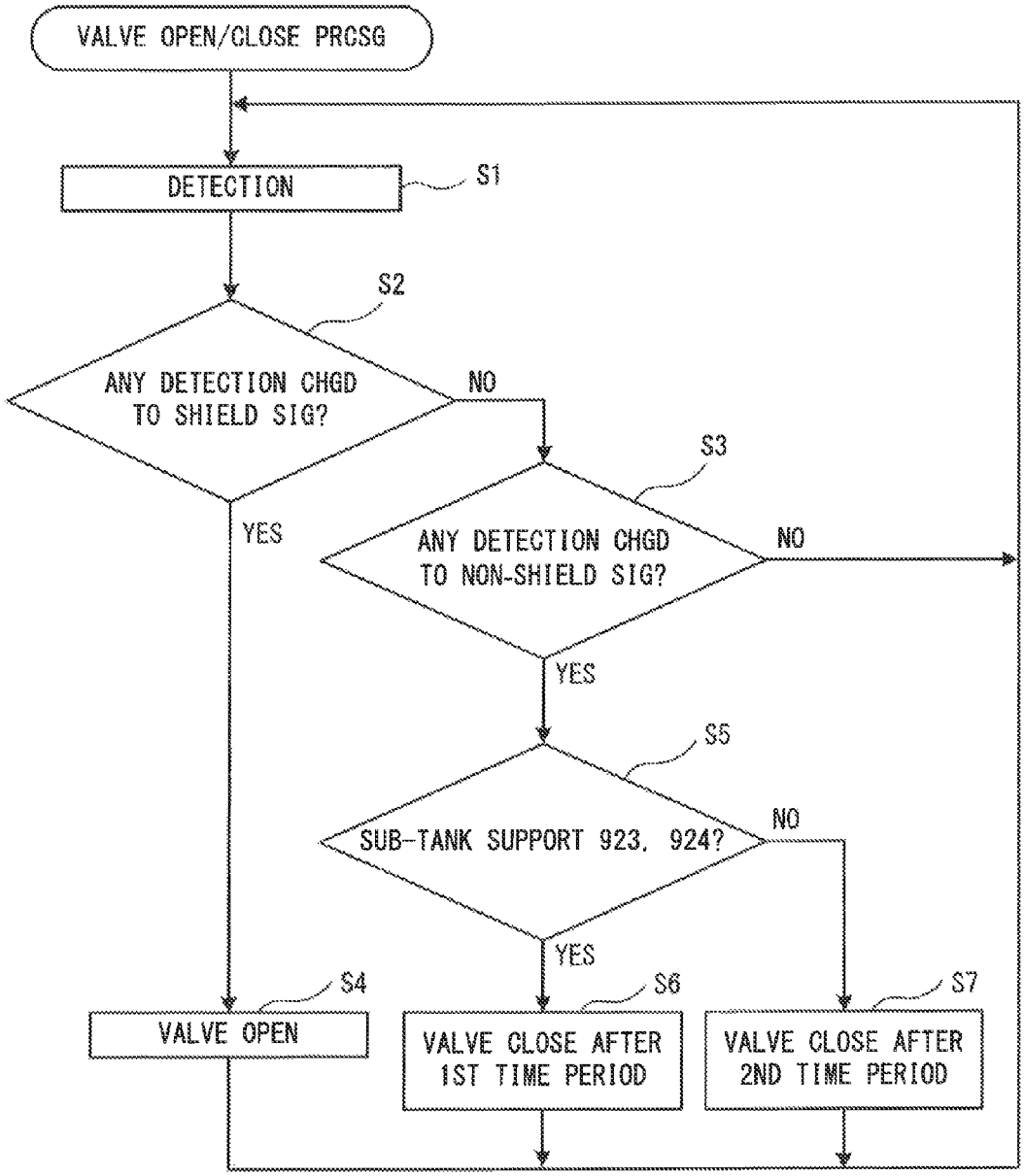
FIG. 18 is a flowchart of valve open/close processing.

Referring to FIG. 18, a valve open/close processing will be described. The CPU 40 reads the control program from the ROM 41, and executes the valve open/close processing (see FIG. 18). Apart from the valve open/close processing, the CPU 40 also carries out the printing process and the circulating process. The valve open/close processing adjusts an amount of the ink 97 to be reserved in the sub-tank 91. The valve open/close processing may be performed after the printing process, or during the printing process.

If the pressure of the ink 97 to be introduced into the sub-tank 91 from the flow-in passage 621, 622, 623, 624 is high, an amount of the ink 97 flowing into the sub-tank 91 per a unit time becomes large. In this embodiment, the sub-tanks 911-914 are arranged in the second region 212, which is a region in which a distance from the nozzle face 111 in the up-down direction is in the predetermined range. On the other hand, the upper mount portions 813 and 814 are arranged above the second region 212 and above the upper mount portions 811 and 812. Thus, the pressure of the ink 97 flowing into the sub-tanks 913 and 914 from the upper mount portions 813 and 814 through the flow-in passages 623 and 624 is higher than the pressure of the ink 97 flowing into the sub-tanks 911 and 912 from the upper mount portions 811 and 812 through the flow-in passages 621 and 622. In this embodiment, therefore, the first time period for opening the valve portions 96 of the flow-in passages 623 and 624, through which the ink 97 flows in the associates sub-tanks 91 at a higher pressure compared to the flow-in passages 621 and 622, is set to be shorter than the second time period for opening the valve portions 96 of the flow-in passages 621 and 622, through which the ink 97 flows in the associated sub-tanks 91 at a lower pressure. This will be described below in detail.

As shown in FIG. 17 and FIG. 18, the CPU 40 uses the detection circuit 191 to detect a shield signal or a non-shield signal on the basis of the output of the optical detecting portion 696 of each sub-tank support 921, 922, 923, 924 (S1). The CPU 40 stores the detection result of S1 in the RAM 42. The CPU 40 compares the detection result of the previous S1 to the detection result of the current S1 to determine whether or not any of the optical detecting portions 696 has detected the change from the non-shield signal to the shield signal (S2). If the shield signal is included at the first S1, it is determined that there is an optical detecting portion 696 that has detected the change from the non-shield signal to the shield signal (S2: YES). If the shield signal is not included at the first S1 (i.e., if all signals are the non-shield signals), then it is determined that there is no optical detecting portion 696 that has detected the change from the non-shield signal to the shield signal (S2: NO).

If there is no optical detecting portion 696 that has changed from the non-shield signal to the shield signal (S2: NO), the CPU 40 compares the detection result of the previous S1 to the detection result of the current S1 to determine whether there is any optical detecting portion 696 that has changed from the shield signal to the non-shield signal (S3). If there is no optical detecting portion 696 that has changed from the shield signal to the non-shield signal (S3: NO), then the CPU 40 causes the processing to return to S1. If S3 is executed after the first S1, it is determined that there is no optical detecting portion 696 that has changed from the shield signal to the non-shield signal (S3: NO).

For example, when the thickness of the bag portion 93 of the sub-tank 911, 912, 913, 914 is greater than the predetermined thickness, the upper portion of the shielding plate 694 is situated above the optical path 670 between the light emitting element 697 and the light receiving element 698 (see FIG. 15). Thus, the light from the light emitting element 697 is received by the light receiving element 698. Accordingly, the CPU 40 detects the non-shield signal on the basis of the output of the optical detecting portion 696 of the sub-tank support 921, 922, 923, 924 (S1). The CPU 40 then determines that there is no optical detecting portion 696 that has changed to the shield signal from the non-shield signal (S2: NO). Also, the CPU 40 determines that there is no optical detecting portion 696 that has changed to the non-shield signal from the shield signal (S3: NO). The CPU 40 repeats S1, S2 (NO), and S3 (NO).

For example, when the thickness of the bag portion 93 decreases upon injection of the ink 97 from the nozzle face 11, and the thickness of the bag portion 93 of any of the sub-tanks 911-914 becomes equal to or smaller than the predetermined thickness, then the upper part of the shielding plate 694 is situated on the optical path 670 (see FIG. 13 and FIG. 16) between the light emitting element 697 and the light receiving element 698 (see FIG. 14). When the sub-tank 91 that has no ink 97 therein is mounted on the sub-tank support 92, the upper part of the shielding plate 694 is situated on the optical path 670 between the light emitting element 697 and the light receiving element 698. The light from the light emitting element 697 is not received by the light receiving element 698 as the upper part of the shielding plate 694 is situated on the optical path 670 between the light emitting element 697 and the light receiving element 698. As such, the CPU 40 receives a shield signal (S1). The CPU 40 determines that there is an optical detecting portion 696 which has switched to the shield signal from the non-shield signal (S2: YES), and opens the valve portion 96 of that sub-tank support 92 which is associated with the change from the non-shield signal to the shield signal (S4). Thus, the cartridge 3 starts supplying the ink 97 to the sub-tank 91 which is supported by the sub-tank support 92 having the opened valve portion 96. The CPU 40 causes the processing to return to S1.

If the supply of the ink 97 starts at S4, the thickness of the bag portion 93 gradually increases, and exceeds the predetermined thickness. In this case, the CPU 40 receives the non-shield signal (S1). The CPU 40 determines that there is an optical detecting portion 696 that has changed from the shield signal to the non-shield signal (S3: YES), and determines whether that optical detecting portion 696 which has had the signal change is the optical detecting portion 696 of the sub-tank support 923 or the optical detecting portion 696 of the sub-tank support 924 (S5). If that optical detecting portion 696 which has had the signal change is the optical detecting portion 696 of the sub-tank support 923 or the optical detecting portion 696 of the sub-tank support 924 (S5: YES), then the valve portion 96 of that sub-tank support 92 which has had the change from the shield signal to the non-shield signal is closed after elapse of the first time period (S6). The first time period is shorter than the second time period (will be described). For example, the first time period is ten seconds. Then, the CPU 40 causes the processing to return to S1.

At S5, when the optical detecting portion 696 that had the signal change is not the optical detecting portion 696 of any of the sub-tank supports 923 and 924 (S5: NO), then the valve portion 96 of the sub-tank support 92 that had the change from the shield signal to the non-shield signal is closed upon elapse of the second time period (S7). In other words, the valve portion 96 of the sub-tank support 921 or 922 is closed as the second time period passes. The second time period is longer than the first time period. For example, the second time period is 15 seconds. Then, the CPU 40 causes the processing to return to S1.

The valve open/close processing is carried out in the above-described manner. In this embodiment, the first time period for opening the valve portions 96 of the flow-in passages 623 and 624, from which the ink 97 flowing into the associated sub-tanks 91 has a higher pressure than the ink flowing from the flow-in passages 621 and 622, is shorter than the second time period for opening the valve portions 96 of the flow-in passages 621 and 622 (see S6 and S7). Thus, variations in the amount of ink 97 to be introduced to the sub-tanks 911-914 become small, as compared to a configuration that sets the first time period for opening the valve portions 96 of the flow-in passages 623 and 624 to be no shorter than the second time period for opening the valve portions 96 of the flow-in passages 621 and 622. Accordingly, variations in the amount of ink 97 to be reserved in the sub-tanks 911-914 become small. As such, it is possible to reduce the possibility that the sub-tanks 911-914 would not have the same liquid head (liquid surface). It is also possible to reduce the possibility that the meniscus on the nozzle 113 would be destroyed and no ink 97 would be injected.

As shown in FIG. 7, the flow-in passage 621 connects the single upper mount portion 811 (see FIG. 6) to the single sub-tank 911. The flow-in passage 623 connects the upper mount portion 813 (see FIG. 6) located above the upper mount portion 811 to the sub-tank 913 that is located closer to the mount portion 80 than the sub-tank 911, with respect to the horizontal direction. As a result, the length of the flow-in passage 621 has the same length as the flow-in passage 623. The flow-in passage 622 connects the single upper mount portion 812 (see FIG. 6) to the single sub-tank 912. The flow-in passage 624 connects the upper mount portion 814 (see FIG. 6) located above the upper mount portion 812 to the sub-tank 914 that is located closer to the mount portion 80 than the sub-tank 912, with respect to the horizontal direction. As a result, the length of the flow-in passage 622 has the same length as the flow-in passage 624. Thus, by taking advantage of the positional difference among the upper mount portions 811-814 in the up-down direction and the positional difference among the sub-tanks 911-914 in the horizontal direction, the flow-in passage 621 has the same length as the flow-in passage 623, and the flow-in passage 622 has the same length as the flow-in passage 624. Accordingly, it is possible to use the same components for the flow-in passages 621 and 623, and to use the same components for the flow-in passages 622 and 624. As such, it is possible to reduce the space for arranging the sub-tanks 911-914 in the horizontal direction, to achieve the communization of the components, and to attain the cost reduction. In this embodiment, the same components are used for all of the flow-in passages 621-624.

Because the length of the flow-in passage 621, 622 is equal to the length of the flow-in passage 623, 624, variations in the pressure loss of the ink 97 flowing in the flow-in passages 621-624 become small, as compared to a configuration that has different lengths between the flow-in passage 621, 622 and the flow-in passage 623, 624. Accordingly, variations in the pressure loss caused by the difference in the lengths of the flow-in passages 621-624 become small. Therefore, it is possible to reduce the possibility that an amount of the ink 97 flowing into the respective sub-tanks 91 would differ from one sub-tank to another sub-tank due to the difference in the pressure loss. As such, it is possible to reduce variations in the amount of ink 97 to be reserved among the sub-tanks 911-914. Thus, it is possible to reduce the possibility that the sub-tanks 911-914 would not have the same liquid head, the meniscus on the nozzle 113 would be destroyed, and no ink 97 would be injected.

The engagement portion 854 engages with the outer surface of the associated reservoir passage 711, 712, 713, 714 (e.g., the outer surface of the associated flow-in passage 621, 622, 623, 624). Therefore, it is possible to reduce the possibility that the flow inlet 941 would be disconnected from the associated reservoir passage 711, 712, 713, 714 and the ink 97 would leak, as compared to a configuration that has no engagement portions 854. It is possible to reduce the possibility that the flow-in passages 621-624 would be disconnected from the reservoir passages 711-714 and the ink 97 would leak. Accordingly, it is possible to supply the ink 97 to the sub-tanks 911-914 in a more reliable manner, and to reduce variations in the amount of ink 97 to be reserved among the sub-tanks 911-914. As such, it is possible to reduce the possibility that the sub-tanks 911-914 would not have the same liquid head, the meniscus on the nozzle 113 would be destroyed, and no ink 97 would be injected.

Each of the valve portions 96 has a first connection port member 962 that is connected to the associated flow-in passage 621, 622, 623, 624, and a second connection port member 963 that is connected to the flow inlet 941. The engagement portion 854 of the flow inlet 941 is coupled to the outer surface of the associated flow-in passage 621, 622, 623, 624 at the periphery of the first connection port member 962. Thus, it is possible to reduce the possibility that the flow-in passages 621-624 are disconnected from the associated first connection port members 962 and the ink 97 would leak, as compared to a configuration that has no engagement portions 854. It is possible to reduce the possibility that the flow inlet 941 would come off the second connection port member 963 and the ink 97 would leak. Accordingly, it is possible to supply the ink 97 to the sub-tanks 911-914 in a more reliable manner, and to reduce variations in the amount of ink 97 to be reserved among the sub-tanks 911-914. Therefore, it is possible to reduce the possibility that the sub-tanks 911-914 would not have the same liquid head, the meniscus on the nozzle 113 would be destroyed, and no ink 97 would be injected.

Because the engagement portion 854 of the flow inlet 941 engages with the associated flow-in passage 621, 622, 623, 624, the flow inlet 941 is difficult to rotate, as compared to a configuration that does not engage the engagement portion 854 of the flow inlet 941 with the associated flow-in passage 621, 622, 623, 624. Thus, it is possible to reduce the possibility that the flow inlet 941 would rotate, which in turn would cause the sub-tank 91 to rotate, and no ink 97 would be injected.

Because the bag portion 93 of the sub-tank 91 inclines relative to the horizontal direction, it is possible to reduce the space in the horizontal direction, as compared to a configuration that has no inclination at the bag portion 93 of the sub-tank 91. The flow outlet 942 is situated above the flow inlet 941, with respect to the bag portion 93. Thus, the gas present in the bag portion 93 is easy to flow out to the downstream side from the flow outlet 942 as the ink 97 is introduced into the sub-tank 91 (the sub-tank 91 is not filled yet with the ink 97 at this point in time), as compared to a configuration that has the flow outlet 942 aligned with the flow inlet 941 in the horizontal direction and a configuration that has the flow outlet 942 below the flow inlet 941. Accordingly, it is possible to reduce the possibility that any gas would be mixed with the ink 97. Therefore, it is possible to reduce the possibility that any gas would remain in the sub-tanks 911-914 and an amount of ink 97 in the sub-tanks 911-914 would change. As such, it is possible to reduce the possibility that the sub-tanks 911-914 would not have the same liquid head, the meniscus on the nozzle 113 would be destroyed, and no ink 97 would be injected. It is possible to reduce the possibility that any gas would be mixed with the ink 97 and the printing quality would drop due to the mixed gas.

It should be noted the present disclosure is not limited to those disclosed in the above mentioned embodiments, but various modification can be made. For example, the white ink may not be high precipitation liquid. Also, the liquid injected from the nozzle face 111 is not limited to the ink 97. Instead, for example, it may be a dye-discharging material for decolorizing the color dying the fabric. Also, non-reservoir passages 72A and 72B may not be provided. Also, the circulation passages 771A, 772A, 771B, 772B and pumps 901 to 904 may not be provided. Furthermore, the shaft portion 43 and the resilient member 45 (see FIG. 5) of the cartridge 3 may not be provided.

It should be noted that the number of the mount portions 80 is not limited to a particular value, and the number of the sub-tanks 91 is not limited to a particular value. For example, the number of the mount portions 80 may be five or more, and the number of the sub-tanks 91 may be five or more. Similar to the flow-in passages 621-624, such configuration may include an additional mount portion which may be disposed above a particular mount portion, an additional flow-in passage which connects to the sub-tank located closer to the mount portion than a particular sub-tank 91 in the horizontal direction, and another additional flow-in passage which connects the particular mount portion to the particular sub-tank 91. By providing these additional components, it is possible for all the flow-in passages to have the same length and use the same components. It should be noted that the flow-in passages 621-624 may have different lengths from each other. The detection portions 69 may be omitted. The flow outlet 942 may be aligned with the flow inlet 941 in the horizontal direction. The flow outlet 942 may be located below the flow inlet 941.

The engagement portions 854 may be provided on both of the flow inlet 941 and the flow outlet 942. The engagement portion 854 may only be provided on the flow outlet 942 among the mouth plugs 94. When the engagement portion 854 is provided on the flow outlet 942, the engagement portion 854 may engage with an outer face of the associated flow-out passage 631, 632, 633, 634. The open-close valve for opening and closing each of the reservoir passages 711-714 is not limited to the valve portion 96. For example, another suitable open-close valve, other than the valve portion 96, may be used. The position of the open-close valve on the associated reservoir passage 711, 712, 713, 714 is not limited to the position illustrated in the drawings. For example, the open-close valve may be provided on the flow outlet 942. In this case, an additional engagement portion 854 may be provided on the flow outlet 942, and the engagement portion 854 may engage with an outer surface of the associated flow-out passage 631, 632, 633, 634 at the periphery of the connection between the open-close valve and the associated flow-out passage 631, 632, 633, 634.

In this embodiment, the first time period for opening the valve portions 96 of the flow-in passages 623 and 624, from which the ink 97 flowing into the associated sub-tanks 91 has a higher pressure than the ink 97 flowing into the associated sub-tanks 91 from the flow-in passages 621 and 622, is shorter than the second time period for opening the valve portions 96 of the flow-in passages 621 and 622 (see S6 and S7). With such configuration, the pressure difference between the flow-in passage 621, 622 and the flow-in passage 623, 624 is based on the positional difference between the upper mount portion 811, 812 and the upper mount portion 813, 814 in the up-down direction in this embodiment. The present invention is not limited in this regard. For example, the upper mount portions 811-814 may be disposed at the same height in the up-down direction, and the passage resistance of the flow-in passage 623, 624 may be set to a smaller value than the passage resistance of the flow-in passage 621, 622. In this case, the pressure of the ink 97 flowing into the associated sub-tank 91 from the flow-in passage having the larger passage resistance is lower than the pressure of the ink 97 flowing into the associated sub-tank 91 from the flow-in passage having the smaller passage resistance. Thus, the pressure of the ink 97 flowing into the associated sub-tank 91 from the flow-in passage 623, 624 is higher than the pressure of the ink 97 flowing into the associated sub-tank 91 from the flow-in passage 621, 622. In this case, the first time period for opening the valve portions 96 of the flow-in passages 623 and 624, from which the ink 97 flowing into the associated sub-tanks 91 has a higher pressure than the ink flowing into the associated sub-tanks 91 from the flow-in passages 621 and 622, may be set to a shorter than the second time period for opening the valve portions 96 of the flow-in passages 621 and 622 (see S6 and S7). When the passage resistance of the flow-in passage 623, 624 is smaller than the passage resistance of the flow-in passage 621, 622, the material of the fluid passage may be changed, and/or the length of the flow-in passage 623, 624 may be shorter than the length of the flow-in passage 621, 622. The inner diameter of the flow-in passage 623, 624 may be larger than the inner diameter of the flow-in passage 621, 622.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head portion including a nozzle face having a nozzle configured to inject liquid;

a plurality of mount portions, each of the plurality of mount portions configured to mount a container that contains the liquid, and the plurality of mount portions including a first mount portion and a second mount portion;

a plurality of fluid passages, each of the plurality of fluid passages configured to connect a corresponding one of the plurality of mount portions to the head portion;

a plurality of reservoir portions configured to reserve the liquid, each of the plurality of reservoir portions being disposed at a corresponding one of the plurality of fluid passages;

a plurality of open-close valves each disposed on a corresponding one of a plurality of connection paths, the plurality of connection paths being part of the plurality of fluid passages and configured to connect the plurality of mount portions to the plurality of reservoir portions; and a control unit configured to control opening and closing of each of the plurality of open-close valves such that a first valve open time period for the open-close valve disposed on a first connection path is shorter than a second valve open time period for the open-close valve disposed on a second connection path, the first connection path and the second connection path being included in the plurality of connection paths, the first mount portion connected to the first connection path being positioned higher than the second mount portion connected to the second connection path, a pressure of the liquid flowing into the reservoir portion from the first connection path being higher than a pressure of the liquid flowing into the reservoir portion from the second connection path.

2. The print device according to claim 1, further comprising a plurality of detectors each configured to output a signal, the signal being a first signal or a second signal in accordance with an amount of ink reserved in a corresponding one of the reservoir portions, the first signal being a signal corresponding to a state in which the amount is equal to or less than a predetermined amount, the second signal being a signal corresponding to a state in which the amount is more than the predetermined amount, wherein:

the control unit is configured to:

obtain the signals from the plurality of detectors;

determine a specific reservoir portion out of the plurality of reservoir portions, the specific reservoir portion being one of the plurality of reservoir portions corresponding to one of the plurality of detectors in which the signal has changed to the first second signal from the first signal; and set a valve open time period of the open-close valve corresponding to the specific reservoir portion to the first valve open time period in case that the specific reservoir portion is disposed at the first connection path and to the second valve open time period in case that the specific reservoir portion is disposed at the second connection path.

3. The print device according to claim 1, wherein each of the plurality of reservoir portions is located in a region in which a distance from the nozzle face in an up-down direction falls within a predetermined range, the plurality of mount portions have a first mount portion and a second mount portion such that the first mount portion is located above the second mount portion, the first connection path is connected to the first mount portion, and the second connection path is connected to the second mount portion.

4. The print device according to claim 1, wherein the plurality of reservoir portions have a first reservoir portion and a second reservoir portion, the first reservoir portion is located closer to the mount portion than the second reservoir portion in a horizontal direction, the first connection path is connected to the first reservoir portion, the second connection path is connected to the second reservoir portion, and a length of the first connection path is equal to a length of the second connection path.

5. The print device according to claim 1, wherein the reservoir portion has a mouth plug that can allow the liquid to flow into and out of the reservoir portion, and an engagement portion that is disposed at the mouth plug and configured to engage with an outer surface of the fluid passage.

6. The print device according to claim 4, wherein the open-close valve has a first connection portion that is connected to the connection path, and a second connection portion that is connected to the mouth plug, and the engagement portion engages with the outer surface of the connection path at a periphery of the first connection portion.

7. The print device according to claim 4 further comprising a plurality of supports, wherein the plurality of supports are configured to support the plurality of reservoir portions respectively such that the plurality of reservoir portions are inclined relative to the horizontal direction, the mouth plug has a first plug portion that can allow the liquid to flow into the reservoir portion and a second plug portion that can allow the liquid to flow out of the reservoir portion, and the second plug portion is located above the first plug portion.

8. The print device according to claim 1, wherein the first mount portion and the second mount portion being positioned higher than the plurality of reservoir portions.

9. The print device according to claim 1, wherein the first connection path is configured to cause a first ink to flow into the reservoir portion, the second connection path is configured to cause the first ink to flow into the reservoir portion, and a specific fluid passage is connected to a third mount portion positioned lower than the first mount portion and the second mount portion, the specific fluid passage being one of the plurality of fluid passages, the specific fluid passage being configured to cause a second ink to flow into the head portion, the second ink being a liquid with higher precipitationability than the first ink.

10. The print device according to claim 9, wherein the specific fluid passage is provided without the reservoir portion.

11. The print device according to claim 9, wherein the specific fluid passage is provided with a circulation passage.

12. The print device according to claim 9, wherein the first ink is a color ink, and the second ink is a white ink.

* * * * *